US008012038B1

(12) United States Patent
Beach et al.

(10) Patent No.: US 8,012,038 B1
(45) Date of Patent: Sep. 6, 2011

(54) GOLF CLUB HEAD

(75) Inventors: Todd P. Beach, San Diego, CA (US); Nathan Sargent, San Marcos, CA (US); Kraig Alan Willett, Fallbrook, CA (US)

(73) Assignee: Taylor Made Golf Company, Inc., Carlsbad, CA (US)

( * ) Notice: Subject to any disclaimer, the term of this patent is extended or adjusted under 35 U.S.C. 154(b) by 20 days.

(21) Appl. No.: 12/316,584

(22) Filed: Dec. 11, 2008

(51) Int. Cl.
*A63B 53/04* (2006.01)

(52) U.S. Cl. ..... 473/329; 473/345; 473/349

(58) Field of Classification Search ..... 473/324–350, 473/287–292
See application file for complete search history.

(56) References Cited

U.S. PATENT DOCUMENTS

| | | | | |
|---|---|---|---|---|
| 3,976,299 | A * | 8/1976 | Lawrence et al. | 473/327 |
| 4,444,392 | A * | 4/1984 | Duclos | 473/290 |
| 4,534,564 | A * | 8/1985 | Yamada | 473/345 |
| 4,653,756 | A * | 3/1987 | Sato | 473/327 |
| 5,464,217 | A * | 11/1995 | Shenoha et al. | 473/350 |
| D392,007 | S * | 3/1998 | Fox | D21/752 |
| 5,785,609 | A * | 7/1998 | Sheets et al. | 473/327 |
| 5,851,159 | A * | 12/1998 | Burrows | 473/345 |
| 6,001,027 | A * | 12/1999 | Hansberger | 473/306 |
| 6,027,416 | A * | 2/2000 | Schmidt et al. | 473/345 |
| 6,152,833 | A * | 11/2000 | Werner et al. | 473/324 |
| 6,319,148 | B1 * | 11/2001 | Tom | 473/290 |
| 6,332,848 | B1 | 12/2001 | Long et al. | |
| D465,251 | S * | 11/2002 | Wood et al. | D21/752 |
| 6,572,491 | B2 * | 6/2003 | Hasebe et al. | 473/349 |
| 6,669,578 | B1 * | 12/2003 | Evans | 473/342 |
| 6,716,114 | B2 * | 4/2004 | Nishio | 473/314 |
| 6,773,360 | B2 | 8/2004 | Willett et al. | |
| 6,800,038 | B2 | 10/2004 | Willett et al. | |
| 6,824,475 | B2 | 11/2004 | Burnett et al. | |
| 6,997,820 | B2 | 2/2006 | Willett et al. | |
| 7,066,832 | B2 | 6/2006 | Willett et al. | |
| 7,066,835 | B2 * | 6/2006 | Evans et al. | 473/346 |
| 7,140,974 | B2 | 11/2006 | Chao et al. | |
| 7,163,468 | B2 * | 1/2007 | Gibbs et al. | 473/329 |
| 7,166,040 | B2 | 1/2007 | Hoffman et al. | |
| 7,186,190 | B1 | 3/2007 | Beach et al. | |
| 7,255,653 | B2 * | 8/2007 | Saso | 473/345 |
| 7,267,620 | B2 | 9/2007 | Chao et al. | |
| 7,331,877 | B2 * | 2/2008 | Yamaguchi et al. | 473/329 |
| 7,377,860 | B2 * | 5/2008 | Breier et al. | 473/334 |
| 7,396,296 | B2 * | 7/2008 | Evans | 473/344 |

(Continued)

FOREIGN PATENT DOCUMENTS

JP 2009-160050 A 7/2009

*Primary Examiner* — Sebastiano Passaniti
(74) *Attorney, Agent, or Firm* — Klarquist Sparkman, LLP

(57) ABSTRACT

A golf club head is described, in one embodiment, including a body with an exterior surface defining a first body volume of at least about 400 $cm^3$. The body has a bottom portion, a top portion, a front portion, and a back portion. A face positioned at the front portion of the body and is configured to receive an impact. A top portion silhouette profile located along a perimeter of the top portion is further described. The top portion silhouette profile defines the outer bounds of the top portion in an X-direction and Y-direction. At least one indentation is located on the bottom portion below the crown silhouette profile. The removal of the at least one indentation from the bottom portion creates a second body volume that is at least 12 $cm^3$ larger than the first body volume.

24 Claims, 18 Drawing Sheets

U.S. PATENT DOCUMENTS

| | | | | |
|---|---|---|---|---|
| 7,407,447 | B2 | 8/2008 | Beach et al. | |
| 7,419,441 | B2 | 9/2008 | Hoffman et al. | |
| 7,524,249 | B2 * | 4/2009 | Breier et al. | 473/342 |
| 7,658,686 | B2 * | 2/2010 | Soracco | 473/342 |
| 7,674,189 | B2 * | 3/2010 | Beach et al. | 473/345 |
| 2005/0181884 | A1 | 8/2005 | Beach et al. | |
| 2006/0240909 | A1 * | 10/2006 | Breier et al. | 473/334 |
| 2007/0298903 | A1 | 12/2007 | Stites et al. | |
| 2008/0132356 | A1 | 6/2008 | Chao et al. | |
| 2008/0146374 | A1 | 6/2008 | Beach et al. | |
| 2008/0149267 | A1 | 6/2008 | Chao | |
| 2008/0300068 | A1 | 12/2008 | Chao | |
| 2009/0048035 | A1 * | 2/2009 | Stites et al. | 473/291 |
| 2009/0075752 | A1 * | 3/2009 | Hirano | 473/345 |
| 2009/0170632 | A1 * | 7/2009 | Beach et al. | 473/345 |

* cited by examiner

GOLF CLUB HEAD

CROSS REFERENCE TO RELATED APPLICATION

This application is related to U.S. patent application Ser. Nos. 11/825,138, 11/870,913, and 11/025,469, which are hereby incorporated herein by reference.

This application also is related to U.S. Pat. Nos. 6,997,820, 7,186,190, 7,267,620, 7,140,974, 6,773,360, 7,166,040, 7,407,447, 6,800,038, 6,824,475, 7,066,832 and 7,419,441, which are hereby incorporated by reference.

BACKGROUND OF THE INVENTION

Golf is a game in which a player, using many types of clubs, hits a ball into each hole on a golf course in the lowest possible number of strokes. Golf club head manufacturers and designers seek to improve certain performance characteristics such as forgiveness, playability, feel, and sound. In addition, the aesthetic of the golf club head must be maintained while the performance characteristics are enhanced.

In general, "forgiveness" is defined as the ability of a golf club head to compensate for mis-hits where the golf club head strikes a golf ball outside of the ideal contact location. Furthermore, "playability" can be defined as the ease in which a golfer can use the golf club head for producing accurate golf shots. Moreover, "feel" is generally defined as the sensation a golfer feels through the golf club upon impact, such as a vibration transferring from the golf club to the golfer's hands. The "sound" of the golf club is also important to monitor because certain impact sound frequencies are undesirable to the golfer.

Golf head forgiveness can be directly measured by the moments of inertia of the golf club head. A moment of inertia is the measure of a golf head's resistance to twisting upon impact with a golf ball. Generally, a high moment of inertia value for a golf club head will translate to a lower amount of twisting in the golf club head during "off-center" hits. Because the amount of twisting in the golf club head is reduced, the likelihood of producing a straight golf shot has increased thereby increasing forgiveness. In addition, a higher moment of inertia can increase the ball speed upon impact thereby producing a longer golf shot.

The United States Golf Association (USGA) regulations constrain golf club head shapes, sizes, and moments of inertia. Due to theses constraints, golf club manufacturers and designers struggle to produce a club having maximum size and moment of inertia characteristics while maintaining all other golf club head characteristics.

SUMMARY OF THE DESCRIPTION

In one embodiment, the present disclosure describes a golf club head comprising a heel portion, a toe portion, a crown, a sole, and a face.

The foregoing and other objects, features, and advantages of the invention will become more apparent from the following detailed description, which proceeds with reference to the accompanying figures According to one aspect of the present invention, a golf club head is provided having a body, a face, a top portion, front portion, back portion, and a bottom portion. The body includes an exterior surface defining a first body volume of at least about 400 $cm^3$. A face positioned at the front portion of the body is described and the face is configured to receive an impact.

A top portion silhouette profile is located along a perimeter of the top portion. The top portion silhouette profile defines the outer bounds of the top portion in an X-direction and Y-direction.

Furthermore, at least one indentation located on the bottom portion below the crown silhouette profile and the removal of the at least one indentation from the bottom portion creates a second body volume that is at least 12 $cm^3$ larger than the first body volume.

In one example of the present invention, the first body volume is about 440 $cm^3$ to about 470 $cm^3$. In another example of the present invention, the first body volume is about 450 $cm^3$ to about 470 $cm^3$. In yet another example of the present invention, the first body volume is about 460 $cm^3$ to about 470 $cm^3$.

In yet another example of the present invention, the first body volume is about 460 $cm^3$ to about 470 $cm^3$ and the second body volume is at least about 14 $cm^3$ larger than the first body volume.

In one example of the present invention, the face has an area of at least about 4,000 $mm^2$. In another example of the present invention, a heel-toe dimension is between about 119 mm and about 127 mm.

In another example of the present invention, a top-bottom dimension is between about 63 mm and about 71 mm and a front-back dimension is between about 111 mm and about 127 mm.

In another aspect of the present invention, the golf club head has a coefficient of restitution greater than about 0.810 and a moment of inertia about a head center of gravity z-axis of at least about 500 $kg \cdot mm^2$. Furthermore, the moment of inertia about a head center of gravity x-axis of at least about 300 $kg \cdot mm^2$.

According to another aspect of the present invention, the golf club head has a head origin defined as a position on the face plane at a geometric center of the face. The head origin includes an x-axis tangential to the face and is generally parallel to the ground when the head is in an address position. At the address position, a positive x-axis extends towards the heel portion and a y-axis extends perpendicular to the x-axis and is generally parallel to the ground. A positive y-axis extends from the face and through the rearward portion of the body and a z-axis extends perpendicular to the ground, to the x-axis and to the y-axis when the head is ideally positioned. Furthermore, a positive z-axis extends from the origin and generally upward. The golf club head has a center of gravity with an x-axis coordinate between about −2 mm and about 7 mm, a y-axis coordinate between about 30 mm and about 40 mm, and a z-axis coordinate between about −7 mm and about 2 mm.

In one example of the present invention, the golf club head has a center of gravity with a z-axis coordinate being less than about −2 mm.

In another example of the present invention, the golf club head has a center of gravity with a y-axis coordinate being greater than about 15 mm.

In yet another example of the present invention, the golf club head has a center of gravity with a z-axis coordinate being less than about −2 mm and a y-axis coordinate being greater than about 15 mm. In addition, the golf club head further comprises a moment of inertia about a head center of gravity z-axis of at least about 500 $kg \cdot mm^2$ and a moment of inertia about a head center of gravity x-axis of at least about 300 $kg \cdot mm^2$.

In one aspect of the present invention, the golf club head has a first sole mode frequency greater than about 3000 Hz.

In one example of the present invention, the removal of the at least one indentation from the bottom portion creates a second body volume that is between about 12 $cm^3$ and 20 $cm^3$ larger than the first body volume.

According to one aspect of the present invention, a golf club head comprises at least one indentation located on the bottom portion. The removal of the at least one indentation from the bottom portion creates a second exterior surface of the body having a second volume, wherein the second volume is about 4%-5% larger than the first volume.

According to another aspect of the present invention, a golf club head comprises at least one indentation located on the bottom portion, wherein the at least one indentation is configured to create a bottom portion volume of greater than about 50% of the total volume.

In one example of the present invention, a golf club head bottom portion volume is greater than about 60% of the total volume.

According to yet another aspect of the present invention, a golf club head comprises a top portion silhouette profile located along a perimeter of the top portion. The top portion silhouette profile defines the outer bounds of the top portion in an X-direction and Y-direction defining an area of at least about 11,000 $mm^2$. The crown silhouette profile area extends substantially in an X-direction and a Y-direction.

In one example of the present invention, at least one indentation is located within the bottom portion of the golf club head and is configured to maintain the crown silhouette profile area of between at least about 11,500 $mm^2$.

In another example of the present invention, at least one indentation is located within the sole and the top portion silhouette profile is a non-triangular shape.

In another example of the present invention, the perimeter of the crown silhouette profile area is defined by the outermost points of the top portion in the X-direction and Y-direction and the face has a face area size of at least about 4,000 $mm^2$.

According to one aspect of the present invention, a top portion silhouette profile is located along a perimeter of the top portion. The top portion silhouette profile defines the outer bounds of the top portion in an X-direction and Y-direction and has a top portion surface area. The bottom portion has a bottom surface area below the top portion silhouette profile, where the top portion surface area divided by the bottom portion surface areas is equal to or less than a ratio of about 0.96.

BRIEF DESCRIPTION OF THE DRAWINGS

The present invention is illustrated by way of example and not limitation in the figures of the accompanying drawings in which like references indicate similar elements.

DETAILED DESCRIPTION

Figure 1A:
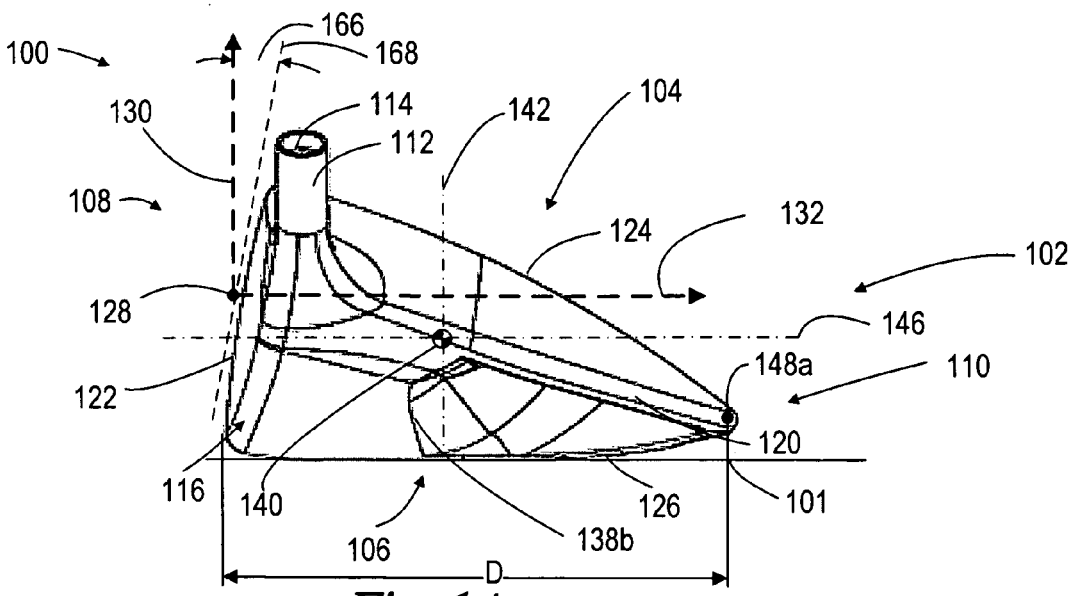
FIG. 1A is an elevated side view of a golf club head showing a golf club head origin coordinate system and a center-of-gravity coordinate system according to a first embodiment.

Various embodiments and aspects of the inventions will be described with reference to details discussed below, and the accompanying drawings will illustrate the various embodiments. The following description and drawings are illustrative of the invention and are not to be construed as limiting the invention. Numerous specific details are described to provide a thorough understanding of various embodiments of the present invention. However, in certain instances, well-known or conventional details are not described in order to provide a concise discussion of embodiments of the present inventions.

Embodiments of a golf club head providing desired center-of-gravity (hereinafter, "CG") properties and increased moments of inertia (hereinafter, "MOI") and projected crown silhouette profiles are described herein. In some embodiments, the golf club head has an optimal shape for providing maximum golf shot forgiveness given a maximum head volume, a maximum head face area, and a maximum head depth according to desired values of these parameters, and allowing for other considerations such as the physical attachment of the golf club head to a golf club and golf club aesthetics.

Forgiveness on a golf shot is generally maximized by configuring the golf club head such that the CG of the golf club head is optimally located and the MOI of the golf club head is maximized.

In certain embodiments, the golf club head has a shape with dimensions at or near at least some of the golf club head dimensional constraints set by current USGA regulations. In such embodiments, the golf club head features fall within a predetermined golf head shape range that results in a desired CG location and increased MOI, and thus more forgiveness on off center hits than conventional golf club heads.

In the embodiments described herein, the "face size" or "striking surface area" is defined according to a specific procedure described herein. A front wall extended surface is first defined which is the external face surface that is extended outward (extrapolated) using the average bulge radius (heel-to-toe) and average roll radius (crown-to-sole). The bulge radius is calculated using five equidistant points of measurement fitted across a 2.5 inch segment along the x-axis (symmetric about the center point). The roll radius is calculated by three equidistant points fitted across a 1.5 inch segment along the y-axis (also symmetric about the center point).

The front wall extended surface is then offset by a distance of 0.5 mm towards the center of the head in a direction along an axis that is parallel to the face surface normal vector at the center of the face. The center of the face is defined according to USGA "Procedure for Measuring the Flexibility of a Golf Clubhead", Revision 2.0, Mar. 25, 2005.

A face front wall profile shape curve (herein, "$S_f$") is defined as the intersection of the external surface of the head with the offset extended front wall surface. Furthermore, the hosel region of the face front wall profile shape curve is trimmed by finding the intersection point (herein, "$P_a$") of Sf with a 30 mm diameter cylindrical surface that is co-axial with the shaft (or hosel) axis. A line is drawn from the intersection point, $P_a$, in a direction normal to the hosel/shaft axis which intersects the curve $S_f$ at a second point (herein, "$P_b$"). The two points, $P_a$ and $P_b$, define two trimmed points of $S_c$. The line drawn from $P_a$ to $P_b$ defines the edge of the "face size" as defined in the present application.

Therefore, the "face size" is a projected area normal to a front wall plane which is tangent to the face surface at the geometric center of the face using the method defined in the USGA "Procedure for Measuring the Flexibility of a Golf Clubhead", Revision 2.0, Mar. 25, 2005.

FIG. 1A shows a wood-type (e.g., driver or fairway wood) golf club head 100 including a hollow body 102 having a top portion 104, a bottom portion 106, a front portion 108, and a back portion 110. The club head 100 also includes a hosel 112 which defines a hosel bore 114 and is connected with the hollow body 102. The hollow body 102 further includes a heel portion 116 and a toe portion 118. A striking surface 122 is located on the front portion 108 of the golf club head 100. In some embodiments, the striking surface 122 can include a bulge and roll curvature or a face plate. The striking surface 122 has a face plane 168 that forms a face angle 166.

In some embodiments of the present invention, the striking surface 122 is made of a composite material as described in U.S. patent application Ser. Nos. 10/442,348 (now U.S. Pat. No. 7,267,620), 10/831,496 (now U.S. Pat. No. 7,140,974), 11/642,310, 11/825,138, and 12/156,947, which are incorporated herein by reference. The composite material can be manufactured according to the methods described in U.S. patent application Ser. No. 11/825,138.

In other embodiments, the striking surface 122 is made from a metal alloy (e.g., titanium, steel, aluminum, and/or magnesium), ceramic material, or a combination of composite, metal alloy, and/or ceramic materials. Moreover, the striking face 122 can be a striking plate having a variable thickness as described in U.S. Pat. Nos. 6,997,820, 6,800,038, 6,824,475, and 7,066,832 which are incorporated herein by reference.

The golf club head 100 also has a first body volume, typically measured in cubic centimeters ($cm^3$), equal to the volumetric displacement of the club head 100, as will be discussed in further detail below.

FIGS. 1-9 generally show a club head origin coordinate system being provided such that the location of various features of the club head (including, e.g., a club head CG) can be determined. In FIG. 1A, a club head origin point 128 is represented on the club head 100. The club head origin point 128 is positioned at the ideal impact location which can be a geometric center of the striking surface 122.

The head origin coordinate system is defined with respect to the head origin point 128 and includes a Z-axis 130, an X-axis 134, and a Y-axis 132. The Z-axis 130 extends through the head origin point 128 in a generally vertical direction relative the ground 101 when the club head 100 is at an address position. Furthermore, the Z-axis 130 extends in a positive direction from the origin point 128 toward the top portion 104 of the golf club head 100.

The X-axis 134 extends through the head origin point 128 in a toe-to-heel direction substantially parallel or tangential to the striking surface 122 at the ideal impact location. The X-axis 130 extends in a positive direction from the origin point 128 to the heel 116 of the club head 100 and is perpendicular to the Z-axis 130 and Y-axis 132.

The Y-axis 132 extends through the head origin point 128 in a front-to-back direction and is generally perpendicular to the X-axis 134 and Z-axis 130. The Y-axis 132 extends in a positive direction from the origin point 128 towards the rear portion or back portion 110 of the club head 100.

The top portion 104 includes a crown 124 that extends substantially in an X-direction and Y-direction and has a top portion volume defined by the top portion 104. Similarly, the bottom portion 106 has a bottom portion volume. The bottom portion 106 also includes a sole area 126 that substantially faces the ground 101 at the address position of the golf club head 100 and also extends primarily in an X and Y-direction.

The top portion volume and the bottom portion volume are combined to create a total first body volume. It is understood that the top 104 and bottom 106 portions are three dimensional objects that also extend in the Z-direction 130.

Moreover, the crown 124 is defined as an upper portion of the club head 100 above a peripheral outline of the club head 100 as viewed from a top-down direction and includes a region rearwards of the top most portion of the front portion 108 that contains the ball striking surface 122. In one embodiment, a skirt region can be located on a side portion 120 of the club head 100 and can include regions within both the top portion 104 and bottom portion 106. In some embodiments, a skirt region is not present or pronounced.

The top 104 and bottom 106 portions can be integrally formed using techniques such as molding, cold forming, casting, and/or forging and the striking face can be attached to the crown, sole, and skirt (if any) through bonding, welding, or any known method of attachment. For example, a face plate can be attached to the body 100 as described in U.S. patent application Ser. Nos. 10/442,348 (now U.S. Pat. No. 7,267,620) and 10/831,496 (now U.S. Pat. No. 7,140,974), as previously mentioned above. The body 100 can be made from a metal alloy such as titanium, steel, aluminum, and or magnesium. Furthermore, the body 100 can be made from a composite material, ceramic material, or any combination thereof. The body 100 can have a thin-walled construction as described in U.S. patent application Ser. No. 11/067,475, now issued U.S. Pat. No. 7,186,190, which is incorporated herein by reference.

Referring to FIGS. 1-9, the golf club heads described herein each have a maximum club head height (H, top-bottom), width (W, heel-toe) and depth (D, front-back). The maximum height, H, is defined as the distance between the lowest and highest points on the outer surface of the golf club head body measured along an axis parallel to the origin Z-axis 130 when the club head is at a proper address position. The maximum depth, D, is defined as the distance between the forward-most and rearward-most points on the surface of the body measured along an axis parallel to the origin Y-axis 132 when the head is at a proper address position. The maximum width, W, is defined as the distance between the farthest distal toe point and closest proximal heel point on the surface of the body measured along an axis parallel to the origin X-axis 134 when the head is at a proper address position.

The height, H, width, W, and depth D of the club head in the embodiments herein are measured according to the United States Golf Association "Procedure for Measuring the Club Head Size of Wood Clubs" revision 1.0 and Rules of Golf, Appendix II(4)(b)(i).

Golf club head moments of inertia are defined about three axes extending through the golf club head CG 140 including: a CG z-axis 142 extending through the CG 140 in a generally vertical direction relative to the ground 101 when the club head 100 is at address position, a CG x-axis 144 extending through the CG 140 in a heel-to-toe direction generally parallel to the striking surface 122 and generally perpendicular to the CG z-axis 142, and a CG y-axis 146 extending through the CG 140 in a front-to-back direction and generally perpendicular to the CG x-axis 144 and the CG z-axis 142. The CG x-axis 144 and the CG y-axis 146 both extend in a generally horizontal direction relative to the ground 101 when the club head 100 is at the address position. Specific CG location values are discussed in further detail below with respect to certain exemplary embodiments.

The moment of inertia about the golf club head CG x-axis 144 is calculated by the following equation:

$$I_{CGx}=\int(y^2+z^2)dm$$

In the above equation, y is the distance from a golf club head CG xz-plane to an infinitesimal mass dm and z is the distance from a golf club head CG xy-plane to the infinitesimal mass dm. The golf club head CG xz-plane is a plane defined by the CG x-axis 144 and the CG z-axis 142. The CG xy-plane is a plane defined by the CG x-axis 144 and the CG y-axis 146.

Moreover, a moment of inertia about the golf club head CG z-axis 142 is calculated by the following equation:

$$I_{CGz}=\int(x^2+y^2)dm$$

In the equation above, x is the distance from a golf club head CG yz-plane to an infinitesimal mass dm and y is the distance from the golf club head CG xz-plane to the infinitesimal mass dm. The golf club head CG yz-plane is a plane defined by the CG y-axis 146 and the CG z-axis 142. Specific moment of inertia values for certain exemplary embodiments are discussed further below.

Figure 1B:
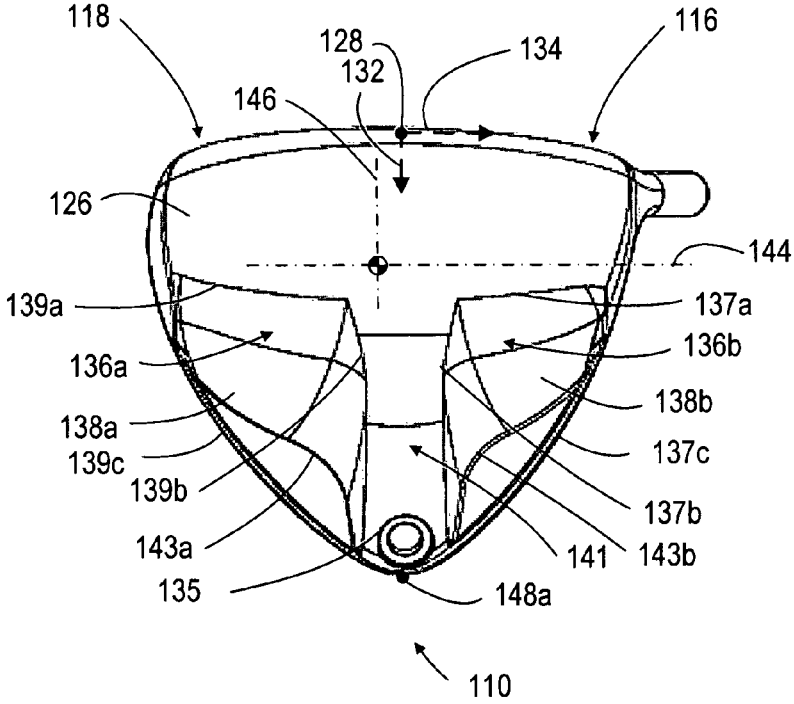
FIG. 1B is a bottom perspective view of the golf club head of FIG. 1A showing the golf club head origin coordinate system and the center-of-gravity coordinate system.

FIG. 1B shows a bottom view of the bottom portion 106 having a first indentation 138*a* and a second indentation 138*b* located on the bottom portion 106 of the club head 100. The first indentation 138*a* is located near the toe portion 118 and the second indentation 138*b* is located near the heel portion 116 of the club head 100. In one exemplary embodiment, the first 138*a* and second 138*b* indentations are generally triangular in shape and arranged so that the sole 126 forms a T-shape. In one embodiment, the first 138*a* and second 138*b* indentations are mirrored across the Y-axis 132 and are about the same shape and size.

The first indentation 138*a* has a first edge 139*a*, a second edge 139*b*, and a third edge 139*c*. The second indentation 138*b* also has a first edge 137*a*, a second edge 137*b*, and a third edge 137*c*. The first edges 138*a*,137*a* of both indentations extend in an X and Y-direction and are generally curved with respect to the X-axis 134. The second edges 138*b*,137*b* of both indentations extend primarily in a Y-direction and are generally curved with respect to the Y-axis 132. The third edge 139*c* of the first indentation 138*a* is a curved edge in the X-Y plane that generally follows a silhouette profile near the toe side 118 of the club head 100. The third edge 137*c* of the second indentation 138*b* is also a curved edge in the X-Y plane that generally follows a silhouette profile near the heel side 116 of the club head 100.

In each indentation 138*a*,138*b*, a convex indentation wall 136*a*,136*b* extends from the first edge 139*a*,137*a* toward the top portion 104 or crown 124 creating a fourth edge 143*a*, 143*b* located within the indentations 138*a*,138*b*. The fourth edge 143*a*,143*b* represents the intersection between the indentation wall 136*a*,136*b* and a bottom surface of the crown 124. Thus, a bottom surface area of the crown 124 is exposed within each indentation 138*a*,138*b* between the fourth edge 143*a*,143*b* and the third edge 137*c*,139*c*.

The convex indentation wall 136*a*,136*b* ensures that the cavity of the club head 100 maintains a certain volume which can affect the sound frequency of the club head 100 upon direct impact with a golf ball. In one embodiment, the frequency of the sole upon direct impact with a golf ball has a first sole mode greater than 3000 Hz. In one exemplary embodiment, the first sole mode frequency is about 3212 Hz while the second and third modes are about 3297 Hz and 3427 Hz, respectively. In certain preferred embodiments, the first sole mode frequency is at between about 3200 to 3500 Hz.

The first 138*a* and second 138*b* indentations are separated by a plateau or center sole portion 141 that extends in a direction parallel to the Y-axis 132. In one exemplary embodiment, the width (along the X-axis 134) of the center sole portion 141 is about 22 mm to about 31 mm between the two indentations 138*a*,138*b*. Furthermore, the width (along the X-axis 134) of each indentation 138*a*,138*b* is about 50 mm to about 57 mm and the length (along the Y-axis 132) of each indentation 138*a*,138*b* is about 69 mm. In another embodiment, the width of each indentation 138*a*,138*b* is about 40 mm and the length of each indentation 138*a*,138*b* is about 65 mm.

The center sole portion 141 also contains a movable weight port 135 located on the sole 126 near the back portion 110 where a movable weight may be inserted or removed to change characteristics of the CG location, as described in U.S. patent application Ser. Nos. 10/290,817 (U.S. Pat. No. 6,773,360), 10/785,692 (U.S. Pat. No. 7,166,040), 11/025,469, 11/067,475 (U.S. Pat. No. 7,186,190), 11/066,720 (U.S. Pat. No. 7,407,447), and 11/065,772 (U.S. Pat. No. 7,419,441), which are hereby incorporated by reference in their entirety.

In one embodiment, the indentations 138*a*,138*b* remove a total of 13 $cm^3$ from a total volume of the club head 100 thereby allowing the saved volume to be reallocated in other regions of the club head 100. For example, the total volume of the club head 100 can be a first body volume of about 461 $cm^3$ before indentation removal and having a second body volume of about 474 $cm^3$ after indentation removal thus providing a 13 $cm^3$ difference.

In another embodiment, the indentations 138*a*,138*b* remove about of 15 $cm^3$ from the total volume of the club head 100. In other words, the removal of the indentations 138*a*, 138*b* would increase the volume of the head 100 by about 13 to 15 cubic centimeters ($cm^3$) to create a second body volume. It is understood that a measuring tolerance of about +/−3 $cm^3$ may be taken into consideration.

In one embodiment, the second body volume (without indentations, i.e. complete indentation removal) is about 4-5% larger than the first body volume (with indentations). In another embodiment, the bottom portion volume is about 71% of the total volume of the club head and the top portion is about 29% of the total volume. In one example, the total volume is about 461 $cm^3$ and the top volume is about 133 $cm^3$ while the bottom volume is about 329 $cm^3$.

The removal of the small indentations discussed throughout the various embodiments of the present invention are accomplished by filling the small indentations with a material (e.g. clay or dough) and covering the small indentations with tape so as to produce a relatively flat plane between the edges of the indentations. A user can take a straight edge or knife and move the straight edge across the entire indentation to remove excess clay or dough material prior to taping (herein, "straight edge" filling procedure). However, the small indentations in the present invention are not considered large enough to be filled prior to measuring the total volume of a club head according to the United States Golf Association "Procedure for Measuring the Club Head Size of Wood Clubs" Revision 1.0 procedures. In one embodiment, the contour after filling the small indentation creates a continuous plane between the edges of the small indentation so that the small indentation is removed or unnoticeable to the user.

In another embodiment, the removal of the small indentations are accomplished by covering the small indentations with tape only (without filler material) to create a continuous surface that connects the edges of the small indentations so that the small indentation is removed or unnoticeable to the user.

In an alternative procedure, the sole volume filling methodology may be a mathematical procedure where the second body volume is measured in an alternative equation as:

$$V_h = V_{hf} - 15\ cm^3$$

In the above equation, $V_h$ is the second body volume and $V_{hf}$ is the volume of the club head after the filling of a large cavity according to the straight edge filling procedure, previously described. Thus, the second body volume could be defined purely as a mathematical expression subtracting 15 $cm^3$ from the filled volume of a club head.

However, the second body volume that is described in the various embodiments of the present invention do not utilize the mathematical procedure of calculating a second body volume. The second body volume measurements described within the present invention are obtained by the straight edge filling procedure as described above.

The sole 126 of the bottom portion 106 is defined as a lower portion of the club head 100 extending upwards from a lowest point of the club head when the club head is positioned at a proper address position relative to a golf ball on a ground surface 101. In some exemplary embodiments, the sole 126 extends about 50-60% of the distance from the lowest point of the club head to the crown 124. In further exemplary embodiments, the sole extends upward in the Z-direction about 15 mm for a driver and between about 10 mm and 12 mm for a fairway wood. The sole 126 can include the entire bottom portion 106 or partially cover a bottom region of the bottom portion 106. The sole 126 and bottom portion 106 are located below the top portion 104 in a negative Z-direction.

Figure 1C:
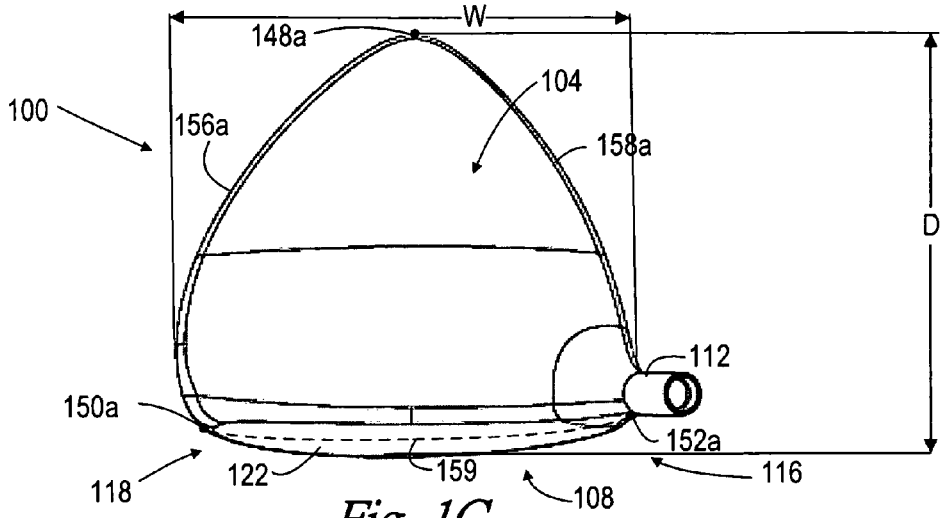
FIG. 1C is a top view of the golf club head of FIG. 1A.

FIG. 1C shows a top view of the club head 100 including the top portion 104, striking surface 122, and the hosel 112. The X-axis 134 and the Y-axis 132 extend from the origin point 128 as previously mentioned (not shown for clarity). A first point 148*a*, a second point 150*a*, and a third point 152*a* are located about the perimeter of the top portion 104. The first point 148*a* is a rearward-most point on the surface of the body measured along an axis parallel to the origin Y-axis 132 when the head 100 is at a proper address position. The second point 150*a* is an intersection point defining the intersection between the front portion 108, the top portion 104, and the bottom portion 106 that is located near the toe portion 118 of the club head 100. The third point 152*a* is an intersection point defining the intersection between the between the front portion 108, the top portion 104, and the bottom portion 106 that is located near the heel portion 116 of the club head 100. In one embodiment, the third point 152*a* defines an intersection that excludes or ignores a majority of the hosel 112.

A top portion silhouette profile includes a first contour 156*a*, a second contour 158*a*, and a third segment 159 being located along a perimeter of the top portion 104 defining the outer bounds of the top portion 104 in substantially an X-direction 134 and Y-direction 132.

The first contour 156*a* extends along an outer toe edge of the club head 100 between the first point 148*a* and second point 150*a*. The second contour 158*a* extends along an outer heel edge of the club head 100 between the first point 148*a* and third point 152*a*. The third segment 159 defining the top portion silhouette profile is a straight line (with respect to the X-axis 134 and Z-axis 130, i.e. viewed from the X-Z plane) along the surface of the front portion 108 or striking surface 122 that connects the second point 150*a* and the third point 152*a*. The first contour 156*a*, second contour 158*a*, and third segment 159 are substantially coplanar.

In certain embodiments, a plane between the top portion 104 and bottom portion 106 that contains the first point 148*a*, second point 150*a*, third point 152*a*, first contour 156*a*, second contour 158*a*, and third segment 159 can be referenced as a dividing plane for measuring a top portion volume and a bottom portion volume. In addition, the same dividing plane is used for measuring a top portion surface area $S_t$ or bottom portion surface area $S_b$. A top and bottom portion volume is measured according to the weighed water displacement method under United States Golf Association "Procedure for Measuring the Club Head Size of Wood Clubs" Revision 1.0 procedures.

Figure 1D:
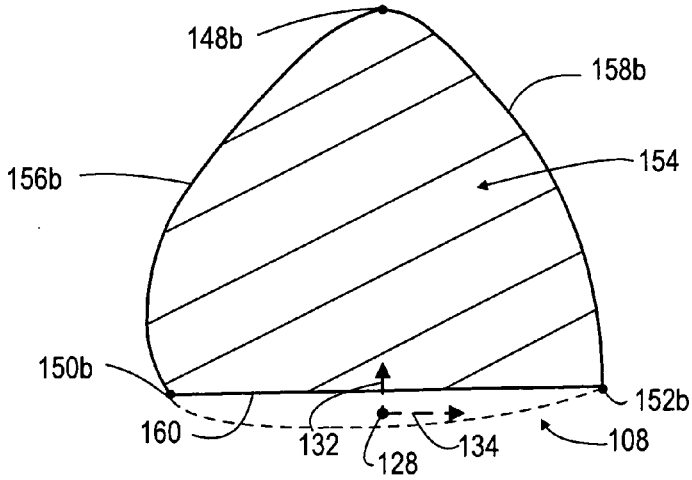
FIG. 1D is a projected crown silhouette of the golf club head in FIG. 1C.

FIG. 1D shows a projected crown silhouette 154 being the top portion silhouette profile shape that is externally projected on to the ground when looking vertically down at the crown 124 when the head 100 is in the address position.

The projected crown silhouette 154 occupies an area in the X-Y plane as emphasized by the hatched lines in FIG. 1D. However, the projected crown silhouette 154 excludes the striking surface 122 and front portion 108 as shown in dashed lines. The projected crown silhouette 154 is defined by the first point projection 148*b*, the second point projection 150*b*, the third point projection 152*b*, and a projected portion of the outer perimeter of the top portion 104 on to the ground 101 or an X-Y plane.

As further shown in FIG. 1D, the projected crown silhouette 154 is defined by three projected segments 156*b*,158*b*, 160 located between the first 148*b*, second 150*b*, and third 152*b* projected points. The first contour 156*a* and the second contour 158*a* are located along the perimeter of the top portion 104 and correspond to the first projected segment 156*b* and the second projected segment 158*b*, respectively. The projected segments 156*b*,158*b* are the projected profiles of the crown on to the X-Y plane or ground 101. The first projected segment 156*b* extends between the first projected point 148*b* and the second projected point 150*b*. The second projected segment 158*b* extends between the first projected point 148*b* and the third projected point 152*b*. The third segment 160 of the profile is a single line segment connecting the second projected point 150*b* and the third projected point 152*b* in the projected X-Y plane. Similar to the first 156*b* and second 158*b* projected segments, the third segment 160 corresponds to an actual crown top line profile contour and is a relatively straight-line boundary drawn between the second projected point 150*b* and third projected point 152*b* running along the top line of the face 122. In other words, the third segment 160 is a projected line of the boundary between the face 122 and the crown 124.

In one embodiment, the projected crown silhouette 154 occupies a projected silhouette area of about 11, 702 $mm^3$ in an X-Y plane which excludes the face 122. The crown silhouette sizes 154 and face sizes 122 described herein are primarily attainable through the removal of volume in the bottom portion 106 of the club head 100. The volume saved in the bottom portion 106 is reallocated to the top portion 104 of the club head 100 to create a larger and more unique projected crown silhouette 154 or top portion perimeter shape.

Figure 1E:
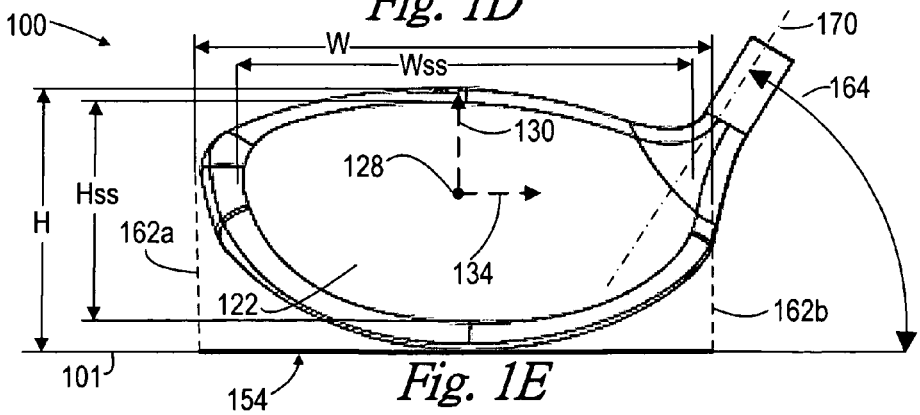
FIG. 1E is an elevated front view of the golf club head of FIG. 1A.

FIG. 1E shows a front view of the club head 100 and striking surface 122 at an address position. Projection lines 162*a*,162*b* are shown in dashed lines to further illustrate how the crown silhouette is projected on to the ground 101, as previously described. It is understood that the crown silhouette can be projected on to any X-Y plane, not necessarily the ground 101 only, without departing from the scope of the invention.

A golf club head, such as the club head 100 is at its proper address position when face angle 166 is approximately equal to the golf club head loft and the golf club head lie angle 164 is about equal to 60 degrees. In other words, the address position is generally defined as the position of the club head as it naturally sits on the ground 101 when the shaft is at 60 degrees to the ground.

The face angle 166 is defined between a face plane 168 that is tangent to an ideal impact location 128 on the striking surface 122 and a vertical Z-X plane containing the Z-axis 130 and X-axis 134. Moreover, the golf club head lie angle 164 is the angle between a longitudinal axis (or hosel axis) 170 of the hosel 112 or shaft and the ground 101 or X-Y plane. It is understood that the ground 101 is assumed to be a level plane.

FIG. 1E further shows the ideal impact location 128 on the striking surface 122 of the golf club head. In one embodiment, the origin point 128 or ideal impact location is located at the geometric center of the striking surface 122. The origin point 128 is the intersection of the midpoints of a striking surface height ($H_{ss}$) and striking surface width ($W_{ss}$) of the striking surface 122 as measured according to the USGA "Procedure for Measuring the Flexibility of a Golf Clubhead", Revision 2.0.

In certain embodiments, the ball striking surface 122 has the maximum allowable surface area under current USGA dimensional constraints for golf club heads in order to achieve a desired level of forgiveness and playability. Specifically, the maximum club head height (H) is about 71 mm (2.8") and a maximum width (W) of about 127 mm (5"). In certain embodiments, the height is about 63.5 mm to 71 mm (2.5" to 2.8") and the width is about 119.38 mm to about 127 mm (4.7" to 5.0"). Furthermore, the depth dimension (D) is about 111.76 mm to about 127 mm (4.4" to 5.0"). In one preferred specific exemplary embodiment, the club height, H, is about 70 mm and the club width is about 126 mm while the club length is about 125 mm.

In one embodiment, the striking surface 122 may reach the maximum height H and width W dimensions as a direct result of the removal of volume from the bottom portion 106. In certain embodiments, the striking surface 122 has a surface area between about 4,000 $mm^2$ and 6,200 $mm^2$ and, in certain preferred embodiments, the striking surface 122 is at least about 5,000 $mm^2$. In other embodiments, the ball striking surface 122 may have a maximum height $H_{ss}$ value of about 67 mm to about 71 mm, a maximum width $W_{ss}$ value of about 118 mm to about 127 mm. In another exemplary embodiment, the striking surface 122 area is about 6,192 $mm^2$, according to the procedure for measuring striking surface area, as previously described.

The golf club head of the implementations shown herein can have a maximum depth D equal to the maximum allowable depth of about 127 mm (5 inches) under current USGA dimensional constraints. Because the moment of inertia of a golf club head about a CG of the head is proportional to the squared distance of a golf club head mass away from the CG, having a maximum depth D value can have a desirable effect on moment of inertia and the CG position of the club head. Thus, the presence of the indentation 138 achieves a large height H, depth D, and width W dimension of the club head 100 while maintaining an advantageous CG location and acceptable MOI values.

Specifically, in some implementations, the CG x-axis coordinate is between about −2 mm and about 7 mm, the CG y-axis coordinate is between about 30 mm and about 40 mm, and the CG z-axis coordinate is between about −7 mm and about 2 mm.

In other embodiments of the present invention, the golf club head 100 can have a CG with a CG x-axis 134 coordinate between about −5 mm and about 10 mm, a CG y-axis 132 coordinate between about 15 mm and about 50 mm, and a CG z-axis 130 coordinate between about −10 mm and about 5 mm. In yet another embodiment, the CG y-axis 132 coordinate is between about 20 mm and about 50 mm.

In one specific exemplary embodiment, the golf club head 100 has a CG with a CG x-axis 134 coordinate of about 2.8 mm, a CG y-axis 132 coordinate of about 31 mm, and a CG z-axis 130 coordinate of about −4.71 mm. In one example, a composite face embodiment can achieve a CG with a CG x-axis 134 coordinate of about 3.0 mm, a CG y-axis 132 coordinate of about 36.5 mm, and a CG z-axis 130 of about −6.0 mm In certain implementations, the club head 100 can have a moment of inertia about the CG z-axis, $I_{CGz}$, between about 450 kg·$mm^2$ and about 650 kg·$mm^2$, and a moment of inertia about the CG x-axis $I_{CGx}$, between about 300 kg·$mm^2$ and about 500 kg·$mm^2$. In one exemplary embodiment, the club head 100 has a moment of inertia about the CG z-axis, $I_{CGz}$, of about 504 kg·$mm^2$ and a moment of inertia about the CG x-axis $I_{CGx}$ of about 334 kg·$mm^2$. In another exemplary embodiment, the striking surface 122 is composed of a composite material previously described and has a moment of inertia about the CG z-axis, $I_{CGz}$, of about 543 kg·$mm^2$ and a moment of inertia about the CG x-axis $I_{CGx}$ of about 382 kg·$mm^2$. In one embodiment, the composite striking surface 122 decreases the total club weight by about 10 g.

In addition, the presence of the indentation 138 in the bottom portion 106 increases the bottom portion surface area $S_b$ located below the top portion silhouette profile 156*a*,158*a*, 159. In certain implementations the club head can have a top portion surface area $S_t$ (which includes the face) of about 16,000 $mm^2$ to 18,000 $mm^2$ and a bottom portion surface area $S_b$ of about 18,000 $mm^2$ to about 22,000 $mm^2$. The surface area ratio $S_r$ of the top portion surface area $S_t$ to the bottom portion surface area $S_b$ is represented by the equation:

$$S_r = \frac{S_t}{S_b}$$

In certain embodiments, the surface ratio $S_r$ can range between about 0.70 to about 0.96, with a preferred range of less than 0.90 and less than 0.80. A lower surface area ratio $S_r$ indicates that the bottom portion has an increased surface area due to the indentations which also provides a volume reduction in the sole area.

In one exemplary embodiment, the top portion 104 surface area $S_t$ is about 17,117 $mm^2$ and the bottom portion 106 surface area $S_b$ including the indentation 138 is about 21,809 $mm^2$ resulting in a total surface area of about 38,926 $mm^2$ and a surface ratio $S_r$ of about 0.78.

Figure 2A:
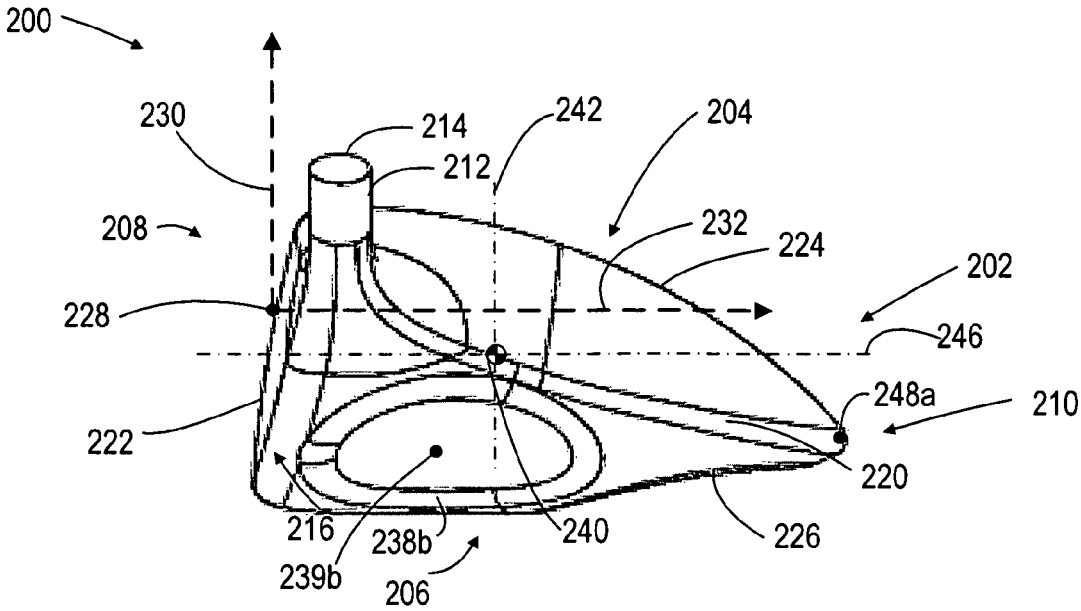
FIG. 2A is an elevated side view of a golf club head showing a golf club head origin coordinate system and a center-of-gravity coordinate system according to a second embodiment.

FIG. 2A shows a wood-type (e.g., driver or fairway wood) golf club head 200 including a hollow body 202 having a top portion 204, a bottom portion 206, a front portion 208, and a back portion 210. A hosel 212 which defines a hosel bore 214 is connected with the hollow body 202. The body 202 further includes a heel portion 216 and a toe portion 218.

FIG. 2A further shows a side portion 220, a striking surface 222, a crown 224, a sole 226, an origin point 228, a Z-axis 230, a Y-axis 232, an X-axis 234, a rearward-most first point 248*a*, a CG point 240, a CG z-axis 242, a CG x-axis 244, a and a CG y-axis 246, as previously described.

Figure 2B:
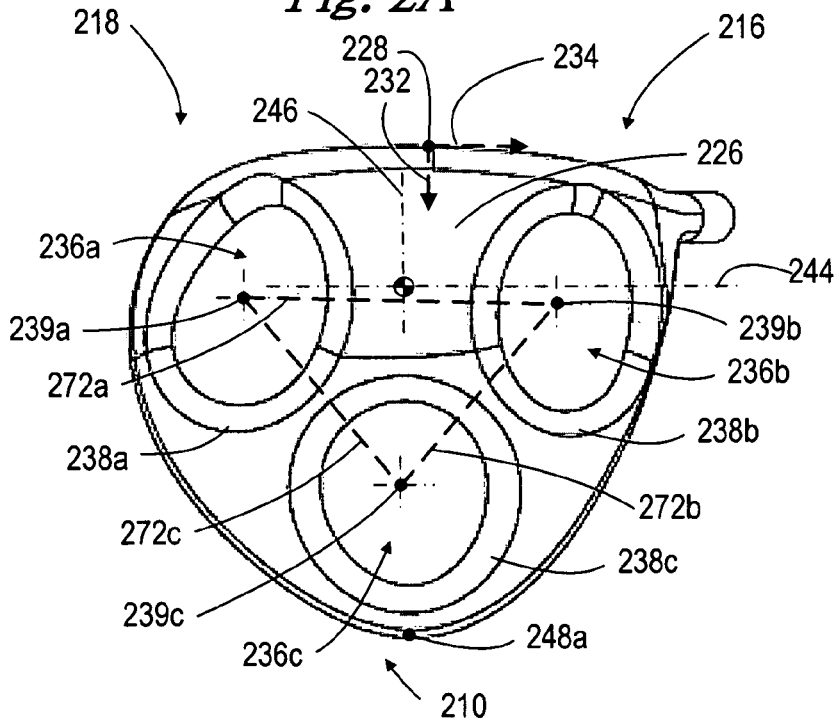
FIG. 2B is a bottom perspective view of the golf club head of FIG. 2A showing the golf club head origin coordinate system and the center-of-gravity coordinate system.

FIG. 2B shows a first indentation 238*a*, a second indentation 238*b*, and a third indentation 238*c* being located on the bottom portion 206 of the club head 200. The three indentations 238*a*,238*b*,238*c* having a first geometric center point 239*a*, a second geometric center point 239*b*, and a third geometric center point 239*c*, respectively. In one embodiment, the indentations each have a diameter of about 40 mm. Furthermore, each indentation 238*a*,238*b*,238*c* has a respective concave surface 236*a*,236*b*,236*c* extending below the top surface of the bottom portion 206. The first indentation 238*a* is located near the toe portion 218 and the second indentation 238*b* is located near the heel portion 218 of the club head 200. The third indentation 238*c* is located near a back portion 210 of the bottom portion 206 and the first 238*a* and second 238*b* indentations are located near the front portion 208 of the bottom portion 206. In one embodiment, the three indentations 238*a*, 238*b*, 238*c* are located in the sole 226 region and the respective geometric center points 239*a*,239*b*,239*c* of the indentations form a triangular shape arrangement that substantially points in a rearward direction or positive Y-direction 232 toward the rear portion 102 of the club head.

In one embodiment, the triangular shape formed by the geometric center points 239*a*,239*b*,239*c* has a first segment 272*a* between the first 238*a* and second 238*b* indentation of about 85 mm. The triangular shape further has a second segment 272*b* between the second 238*b* and third 238*c* indentation of about 70 mm and a third segment 272*c* of about 70 mm between the third 238*c* and first indentation 238*a*. In one embodiment, the angle between the first 272*a* and third 272*c* segment is about 52.6° and the angle between the first 272*a* and second 272*b* segment is also about 52.6°. Moreover, the angle between the second 272*b* and third 272*c* segment is about 74.7°.

In one embodiment, the three indentations 238*a*, 238*b*, 238*c* remove a total of about 14-15 $cm^3$ from a total volume of the club head 200 allowing the saved volume to be reallocated in other regions of the club head 200, such as the face 222 and the top portion 204. In another embodiment, each indentation removes about of 4.6 $cm^3$ from the total volume of the club head 200. In other words, the removal of the indentations 238 would increase the volume of the head 200 by about 14 cubic centimeters ($cm^3$) to create a second body volume. In one example, the first body volume is about 458 $cm^3$ and the second body volume (without indentations) is about 472 $cm^3$ when using the water displacement test previously described.

In one embodiment, the second body volume (without indentations) is about 4-5% larger than the first body volume (with indentations). In another embodiment, the bottom portion volume is about 54% of the total volume of the first body volume of the club head which is about 464 $cm^3$. Furthermore, the top portion volume is about 213 $cm^3$ and the bottom portion volume is about 251 $cm^3$.

Figure 2C:
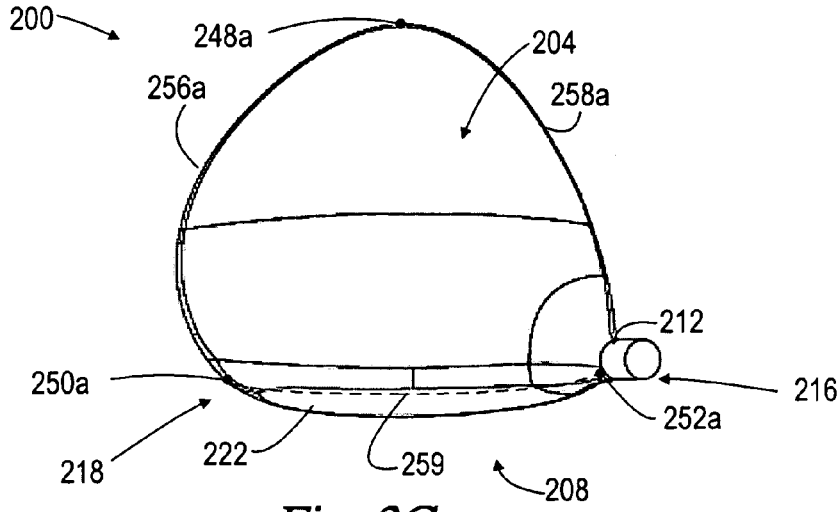
FIG. 2C is a top view of the golf club head of FIG. 2A.

FIG. 2C shows a top view of the club head 200 including the top portion 204, striking surface 222, and the hosel 212. The X-axis 234 and the Y-axis 232 extend from the origin point 228 as previously mentioned. A first point 248*a*, a second point 250*a*, and a third point 252*a* are located about the perimeter of the top portion 204 as previously described.

Again, a top portion silhouette profile is shown including a first contour 256*a*, a second contour 258*a*, and a third segment 259 is located along a perimeter of the top portion 204 defining the outer bounds of the top portion 204 in substantially an X-direction 234 and Y-direction 232.

The first contour 256*a* extends along an outer toe edge of the club head 200 between the first point 248*a* and second point 250*a*. The second contour 258*a* extends along an outer heel edge of the club head 200 between the first point 248*a* and third point 252*a*. The third segment 259 defining the top portion silhouette profile is a line along the surface of the front portion 208 or striking surface 222 that connects the second point 250*a* and the third point 252*a*. The first contour 256*a*, second contour 258*a*, and third segment 259 are substantially coplanar.

Figure 2D:
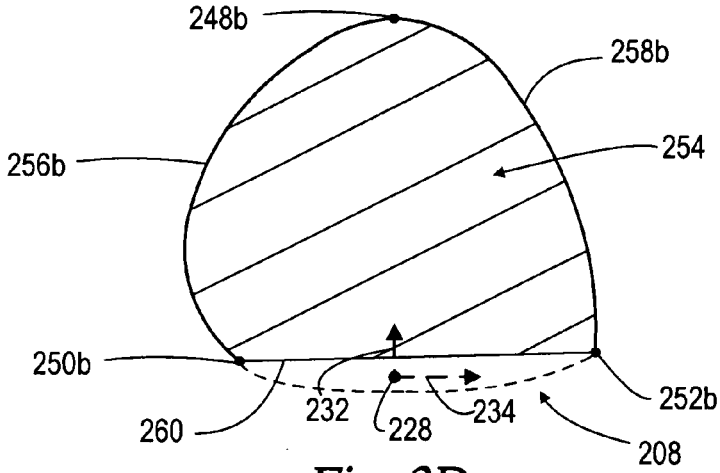
FIG. 2D is a projected crown silhouette of the golf club head in FIG. 2C.

FIG. 2D shows a projected crown silhouette 254 being the top portion silhouette profile shape that is externally projected on to the ground when looking vertically down at the crown 224 when the head 200 is in the address position, as previously described. As noted above, the crown silhouette 254 is defined by three projected points 248*b*,250*b*,252*b* and three segments 256*b*,258*b*,260 shown in an X-Y plane or ground 201 plane as previously described.

In one embodiment, the projected crown silhouette 254 occupies a projected silhouette area of 11,975 $mm^3$ in an X-Y plane while having a width W, height H, and depth D dimension of 124 mm, 65 mm, and 123 mm, respectively.

Furthermore, the golf club head 200 has a CG with a CG x-axis 234 coordinate, a CG y-axis 232 coordinate, and a CG z-axis 230 coordinate within the ranges described previously. The CG location is measured from the origin point 228.

Furthermore, the club head 200 has a moment of inertia about the CG z-axis, $I_{CGz}$, and the CG x-axis $I_{CGx}$ that are within the range of values previously described.

In one exemplary embodiment, the top portion 204 surface area $S_t$ is about 17,792 $mm^2$ and the bottom portion 206 surface area $S_b$ including the indentation 238 is about 18,752 $mm^2$ resulting in a total surface area of about 36,544 $mm^2$ and a surface ratio $S_r$ of about 0.95.

Figure 2E:
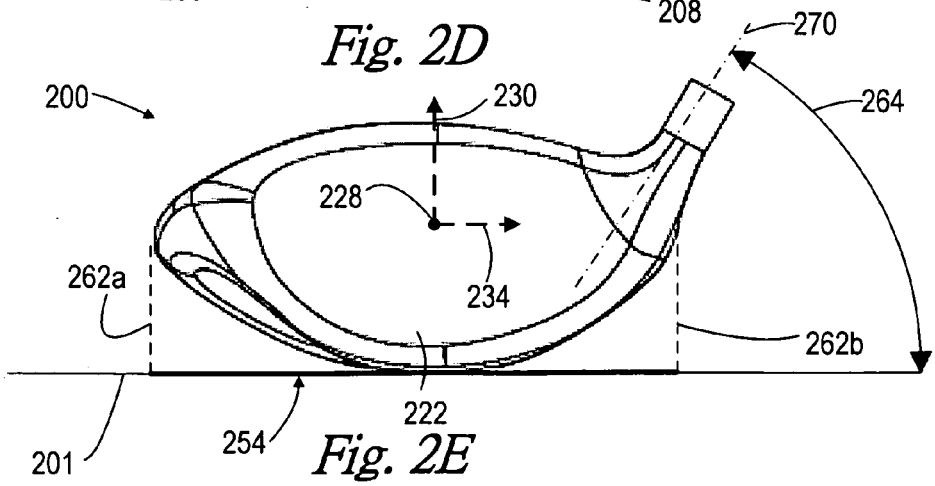
FIG. 2E is an elevated front view of the golf club head of FIG. 2A.

FIG. 2E shows a front view of the club head 200 and striking surface 222 at an address position having a hosel longitudinal axis 270 and angle 264. Again, projection lines 262*a*,262*b* are shown in dashed lines to further illustrate how the crown silhouette 254 is projected on to the ground 201, as previously described.

In one embodiment, the ball striking surface 222 may have a maximum height H value of about 67 mm to about 71 mm, a maximum width W value of about 118 mm to about 127 mm and a corresponding ball striking surface 222 area of about 4,793 $mm^2$.

Figure 3A:
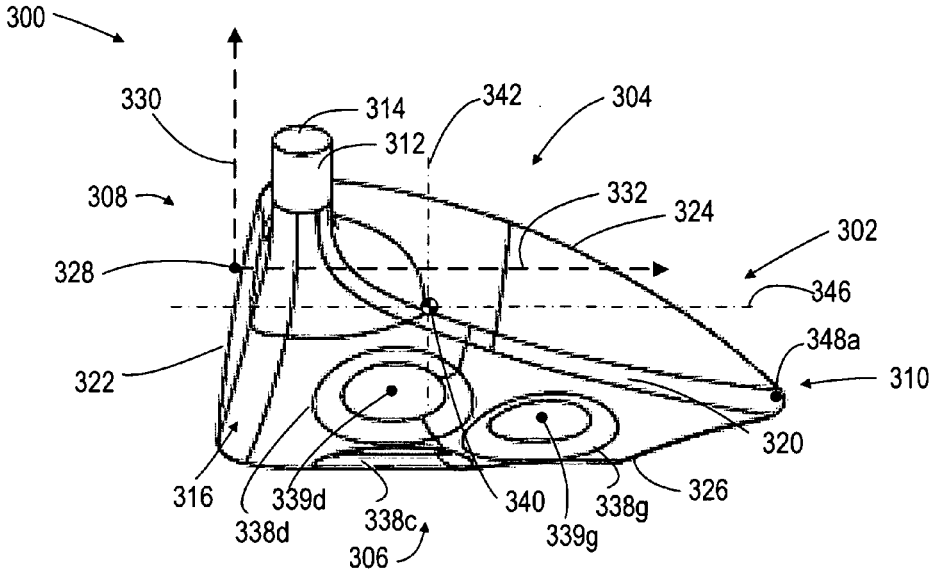
FIG. 3A is an elevated side view of a golf club head showing a golf club head origin coordinate system and a center-of-gravity coordinate system according to a third embodiment.

FIG. 3A shows a wood-type (e.g., driver or fairway wood) golf club head 300 including a hollow body 302 having a top portion 304, a bottom portion 306, a front portion 308, and a back portion 310. A hosel 312 which defines a hosel bore 314 is connected with the hollow body 302. The body 302 further includes a heel portion 316 and a toe portion 318.

FIG. 3A further shows a side portion 320, a striking surface 322, a crown 324, a sole 326, an origin point 328, a Z-axis 330, a Y-axis 332, an X-axis 334, a rearward-most point 348*a*, a CG point 340, a CG z-axis 342, a CG x-axis 344, a and a CG y-axis 346, as previously described.

Figure 3B:
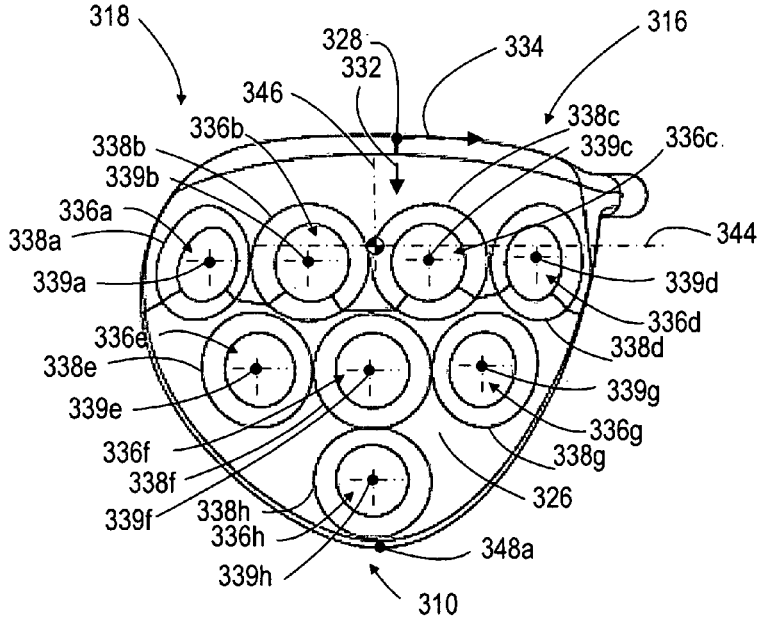
FIG. 3B is a bottom perspective view of the golf club head of FIG. 3A showing the golf club head origin coordinate system and the center-of-gravity coordinate system.

FIG. 3B shows a first indentation 338*a*, a second indentation 338*b*, a third indentation 338*c*, a fourth indentation 338*d*, fifth indentation 338*e*, sixth indentation 338*f*, seventh indentation 338*g*, and eighth indentation 338*h* being located on the bottom portion 306 of the club head 300. In one embodiment, the indentations are located exclusively on the bottom portion 306 of the club head 300 and each have a diameter of about 25 mm. Each indentation has a respective geometric center point 339*a*,339*b*,339*c*,339*d*,339*e*,339*f*,339*g*,339*h* and includes a corresponding concave surface 336*a*,336*b*,336*c*,336*d*,336*e*, 336*f*,336*g*,336*h* that extends into the bottom portion 306 or sole 326 of the club head 300.

FIG. 3B further shows the indentations being configured in three rows substantially parallel to the X-direction 334. A first row contains four indentations 338*a*,338*b*,338*c*,338*d* having the first indentation 338*a* being located near a toe portion 318 and the fourth indentation 338*d* being located near the heel portion 316. A second row contains three indentations 338*e*, 338*f*,338*g* and a third row contains one indentation 338*h* located near the rearward-most point 348*a*. Thus, the arrangement of the first, second, and third rows of indentations form a generally triangular arrangement of indentations on the bottom portion 306 or sole 326.

In one embodiment, the indentations 338*a*,338*b*,338*c*, 338*d*,338*e*,338*f*,338*g*, 338*h* are equally spaced in the X-direction 334 from one another across the surface of the bottom portion 306. In addition, the first, second, and third rows are equally spaced from one another across the surface of the bottom portion 306. It is understood that the indentations can vary in spacing with respect to each other and need not be equidistant.

In one embodiment, the eight indentations 338*a*,338*b*, 338*c*,338*d*,338*e*, 338*f*,338*g*, 338*h* remove a total of about 15 to 16 $cm^3$ from a total volume of the club head 300 allowing the saved volume to be reallocated in other regions of the club head 300. In another embodiment, each indentation removes about of 1.875 $cm^3$ from the total volume of the club head 300. In other words, the removal of the indentations 338 would increase the volume of the head 300 by about 15 $cm^3$ to create a second body volume. The first body volume can be about 459 $cm^3$ and the second body volume can be about 475 $cm^3$ according to the water displacement method.

In one embodiment, the second body volume (without indentations) is about 4-5% larger than the first body volume (with indentations). In another embodiment, the bottom portion volume is about 56% of the total volume of the club head. Furthermore, the top portion volume can be about 205 $cm^3$ and the bottom portion volume can be about 259 $cm^3$ resulting in a total volume of about 463 $cm^3$.

Figure 3C:
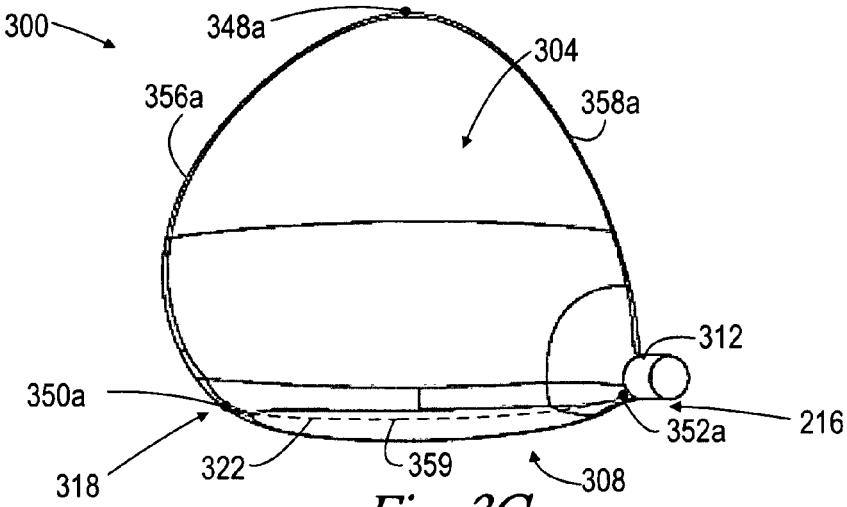
FIG. 3C is a top view of the golf club head of FIG. 3A.

FIG. 3C shows a top view of the club head 300 including the top portion 304, striking surface 322, and the hosel 312. The X-axis 334 and the Y-axis 332 extend from the origin point 328 as previously mentioned. The club head 300 also has a first point 348*a*, a second point 350*a*, and a third point 352*a* located about the perimeter of the top portion 304 as previously described.

Again, a top portion silhouette profile is shown including a first contour 356*a*, a second contour 358*a*, and a third segment 359 is located along a perimeter of the top portion 304 defining the outer bounds of the top portion 304 in substantially an X-direction 334 and Y-direction 332 as previously described.

Again, in one embodiment, the first contour 356*a*, second contour 358*a*, and third segment 359 are substantially coplanar.

Figure 3D:
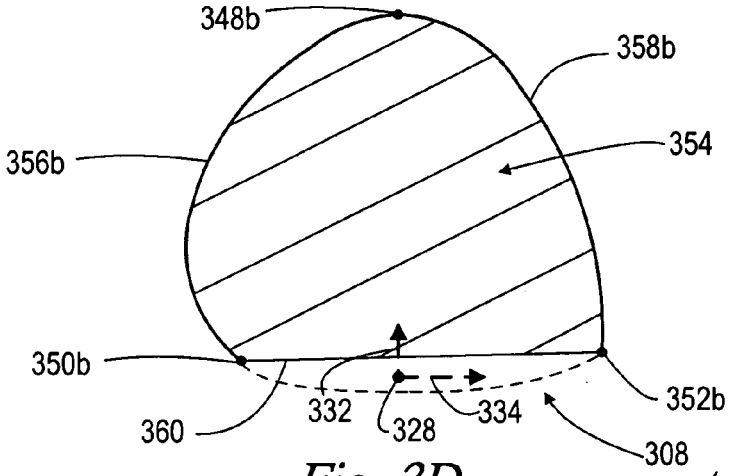
FIG. 3D is a projected crown silhouette of the golf club head in FIG. 3C.

FIG. 3D shows a projected crown silhouette 354 being the top portion silhouette profile shape that is externally projected on to the ground when looking vertically down at the crown 324 when the head 300 is in the address position, as previously described. As noted above, the crown silhouette 354 is defined by three projected points 348*b*,350*b*,352*b* and three segments 356*b*,358*b*,360 shown in an X-Y plane or ground 301 plane. In one embodiment, the projected crown silhouette occupies a projected silhouette area 354 of about 11,999 $mm^2$ in an X-Y plane.

Furthermore, the golf club head 300 has a CG with a CG x-axis 334 coordinate, a CG y-axis 332 coordinate, and a CG z-axis 330 coordinate within the ranges described above. In addition, the club head 300 has a moment of inertia about the CG z-axis, $I_{CGz}$, and a moment of inertia about the CG x-axis $I_{CGx}$ that are within the ranges described above.

In one exemplary embodiment, the top portion 304 surface area $S_r$ is about 17,562 $mm^2$ and the bottom portion 306 surface area $S_b$ including the indentation 338 is about 19,654 $mm^2$ resulting in a total surface area of about 37,216 $mm^2$ and a surface ratio $S_r$ of about 0.89.

Figure 3E:
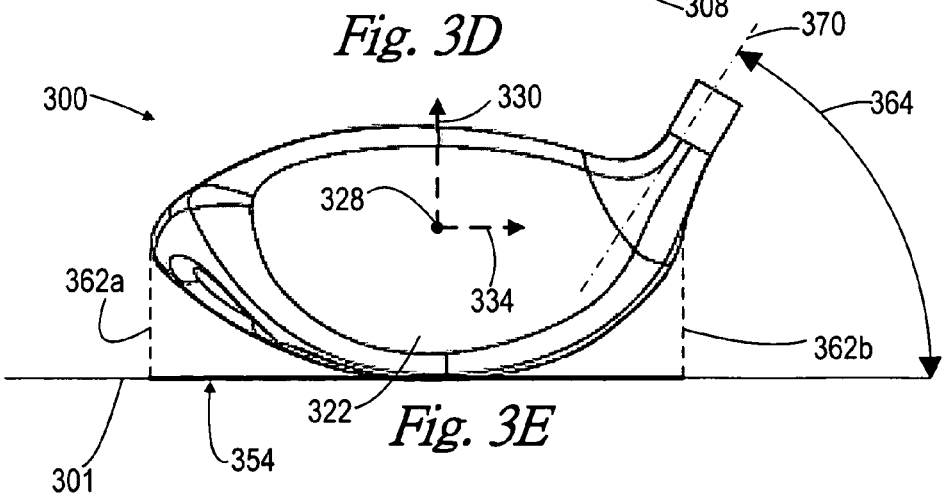
FIG. 3E is an elevated front view of the golf club head of FIG. 3A.

FIG. 3E shows a front view of the club head 300 and striking surface 322 at an address position having a hosel longitudinal axis 370 and angle 364. Again, projection lines 362*a*,362*b* are shown in dashed lines to further illustrate how the crown silhouette 354 is projected on to the ground 301, as previously described.

In one embodiment, the ball striking surface 322 may have a maximum height H value of about 67 mm to about 71 mm, a maximum width W value of about 118 mm to about 127 mm and a corresponding ball striking surface 322 area of about 4,793 $mm^2$.

Figure 4A:
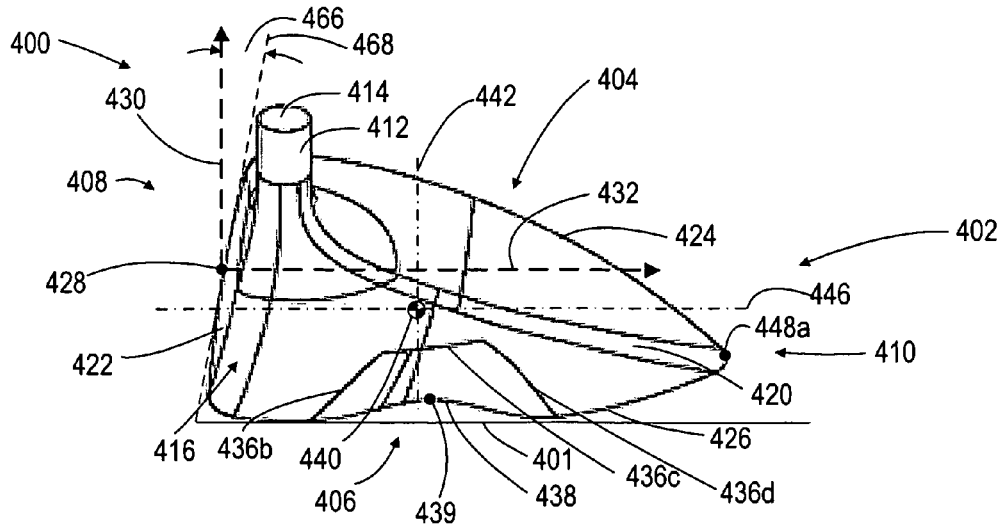
FIG. 4A is an elevated side view of a golf club head showing a golf club head origin coordinate system and a center-of-gravity coordinate system according to a fourth embodiment.

FIG. 4A shows a wood-type (e.g., driver or fairway wood) golf club head 400 including a hollow body 402 having a top portion 404, a bottom portion 406, a front portion 408, and a back portion 410. A hosel 412 which defines a hosel bore 414 is connected with the hollow body 402. The body 402 further includes a heel portion 416 and a toe portion 418.

FIG. 4A further shows a side view of a club head 400 having a side portion 420, a striking surface 422, a crown 424, a sole 426, an origin point 428, a Z-axis 430, a Y-axis 432, an X-axis 434, a rearward-most point 448*a*, a CG point 440, a CG z-axis 442, a CG x-axis 444, a and a CG y-axis 446, as previously described.

Figure 4B:
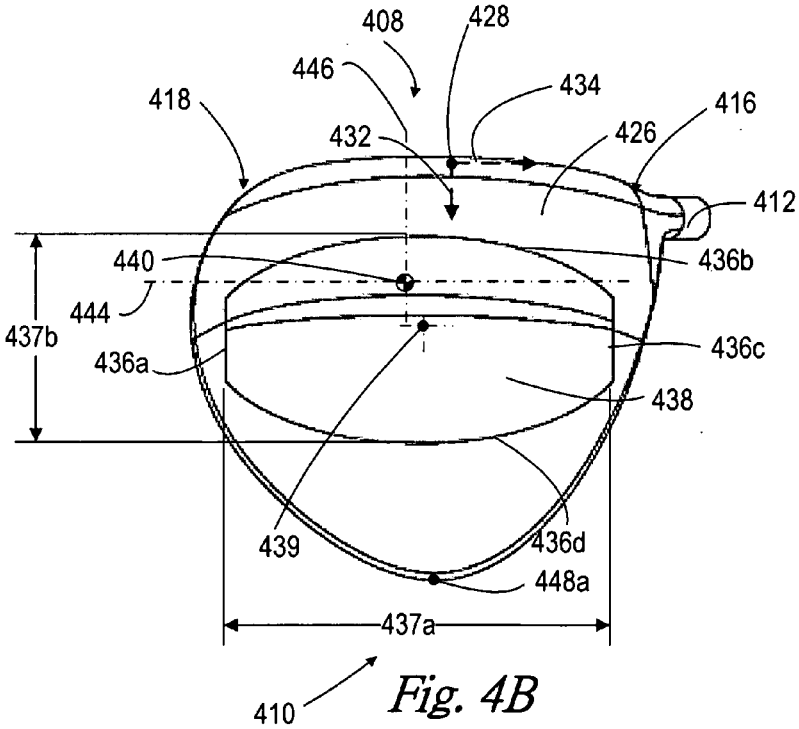
FIG. 4B is a bottom perspective view of the golf club head of FIG. 4A showing the golf club head origin coordinate system and the center-of-gravity coordinate system.

FIG. 4B shows a bottom view having an indented channel or groove 438 located on the bottom portion 406 of the club head 400. In one exemplary embodiment, the indented groove 438 creates an indentation 438 having a width 437*a* of about 100 mm to 120 mm in the X-direction 434 and a length 437*b* of about 50 mm to 60 mm in the Y-direction 432. Thus, the groove indentation 438 extends primarily in the X-direction 434.

The groove indentation 438 is generally defined by four indentation edges 436*a*,436*b*,436*c*,436*d*. The first indentation edge 436*a* and third indentation edge 436*c* extends parallel to the Y-axis 432. The second 436*b* and fourth 436*d* indentation edges are curved segments extending primarily in the X-direction 434 to connect the first 436*a* and third 436*c* indentation edges.

In one embodiment, the groove indentation 438 is centrally located on the bottom portion 406 or sole 426 only. Referring to FIG. 4A, the groove indentation 438 has a slightly convex shaped initial side profile contour moving from the second 436*b* and fourth 436*d* indentation edge toward the center 439 of the groove indentation 438. The side profile of the groove indention 438, within a Y-Z plane, transitions from the initial convex profile contour to a concave indentation profile contour located at the deepest point of the groove indentation 438. It is understood that the groove indentation 438 can be a different shape configuration such as an elongated oval or substantially square shape without departing from the scope of the invention.

In certain embodiments, the groove indentation 438 removes a total of about 10 $cm^3$ to 17 $cm^3$ from a total volume of the club head 400 thereby allowing the saved volume to be reallocated in other regions of the club head 400. In another embodiment, the groove indentation 438 removes about of 15 $cm^3$ from the total volume of the club head 400. In other words, the removal of the groove indentation 438 would increase the volume of the head 400 by about 15 $cm^3$ to create a second body volume. In some embodiments, the second body volume (without indentations) is about 4-5% larger than the first body volume (with indentations). In certain embodiments, the bottom portion volume is about 53% to about 71% of the total volume of the club head. In one exemplary embodiment, the bottom portion volume is about 326 $cm^3$, the top portion volume is about 135 $cm^3$, and the total volume is about 461 $cm^3$. In another embodiment, the bottom portion volume is about 253 $cm^3$, the top portion volume is about 211 $cm^3$, and the total volume is about 464 $cm^3$.

Figure 4C:
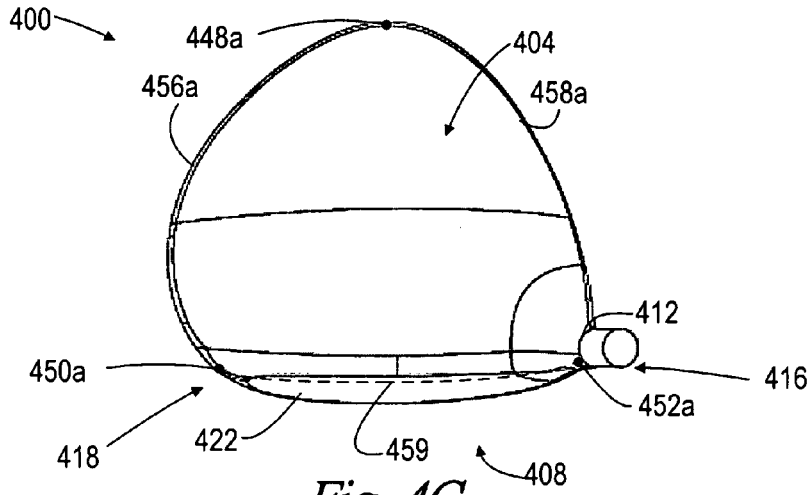
FIG. 4C is a top view of the golf club head of FIG. 4A.

FIG. 4C shows a top view of the club head 400 including the top portion 404, striking surface 422, and the hosel 412. The X-axis 434 and the Y-axis 432 extend from the origin point 428 as previously mentioned. The club head 400 also has a first point 448*a*, a second point 450*a*, and a third point 452*a* located about the perimeter of the top portion 404 as previously described.

Again, a top portion silhouette profile is shown including a first contour 456*a*, a second contour 458*a*, and a third segment 459 is located along a perimeter of the top portion 404 defining the outer bounds of the top portion 404 in substantially an X-direction 434 and Y-direction 432 as previously described. Again, the first contour 456*a*, second contour 458*a*, and third segment 459 are substantially coplanar in one embodiment.

Figure 4D:
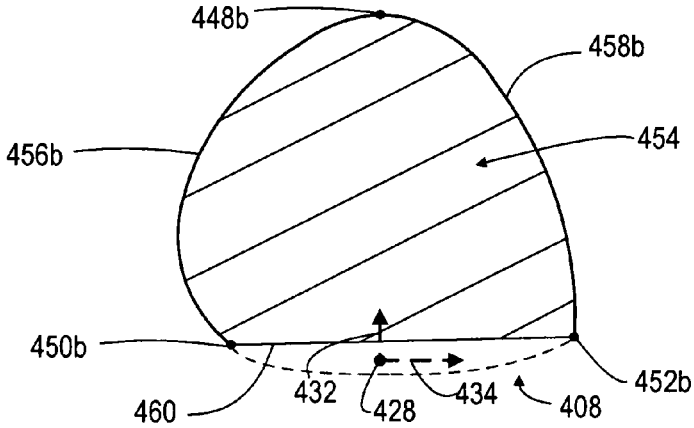
FIG. 4D is a projected crown silhouette of the golf club head in FIG. 4C.

FIG. 4D shows a projected crown silhouette 454 being the top portion silhouette profile shape that is externally projected on to the ground when looking vertically down at the crown 424 when the head 400 is in the address position, as previously described. As noted above, the crown silhouette 454 is defined by three projected points 448*b*,450*b*,452*b* and three segments 456*b*,458*b*,460 shown in an X-Y plane or ground 401 plane. In one embodiment, the projected crown silhouette 454 occupies a projected silhouette area of about 12,120 $mm^2$ in an X-Y plane while having a width W, height H, and depth D dimension of about 125 mm, 65 mm, and 123 mm, respectively. In addition, the face size includes a striking surface 422 area of about 4,793 $mm^2$. In another embodiment, the projected crown silhouette 454 occupies a projected silhouette area of about 11,702 $mm^2$ while having a width W, height H, and depth D dimension of about 126 mm, 70 mm, and 125 mm, respectively. Furthermore, the face size includes a striking surface 422 area of about 5,531 $mm^2$.

Furthermore, the golf club head 400 has a CG with a CG x-axis 434 coordinate of about 2.9 mm, a CG y-axis 432 coordinate of about 31.8 mm, and a CG z-axis 430 coordinate of about −4.87 mm. It is understood than other CG locations within the above described ranges can be achievable. In one example, a composite face embodiment can achieve a CG with a CG x-axis 434 coordinate of about 3.1 mm, a CG y-axis 432 coordinate of about 37.3 mm, and a CG z-axis 430 of about −6.1 mm.

In one exemplary embodiment, the club head 400 has a moment of inertia about the CG z-axis, $I_{CGz}$, of about 523 kg·mm$^2$ and a moment of inertia about the CG x-axis $I_{CGx}$ of about 356 kg·mm$^2$. Again, if a composite face already described above is utilized, the $I_{CGz}$ is about 560 kg·mm$^2$ and the $I_{CGx}$ is about 401 kg·mm$^2$. Furthermore, the club head 400 can have a first sole mode frequency greater than 3,000 Hz as previously described.

In one exemplary embodiment, the top portion 404 surface area $S_t$ is about 17,745 mm$^2$ and the bottom portion 406 surface area $S_b$ including the indentation 438 is about 18,727 mm$^2$ resulting in a total surface area of about 36,472 mm$^2$ and a surface ratio $S_r$ of about 0.95.

In another exemplary embodiment, the top portion 404 surface area $S_t$ is about 16,089 mm$^2$ and the bottom portion 406 surface area $S_b$ including the indentation 438 is about 21,738 mm$^2$ resulting in a total surface area of about 37,827 mm$^2$ and a surface ratio $S_r$ of about 0.74.

Figure 4E:
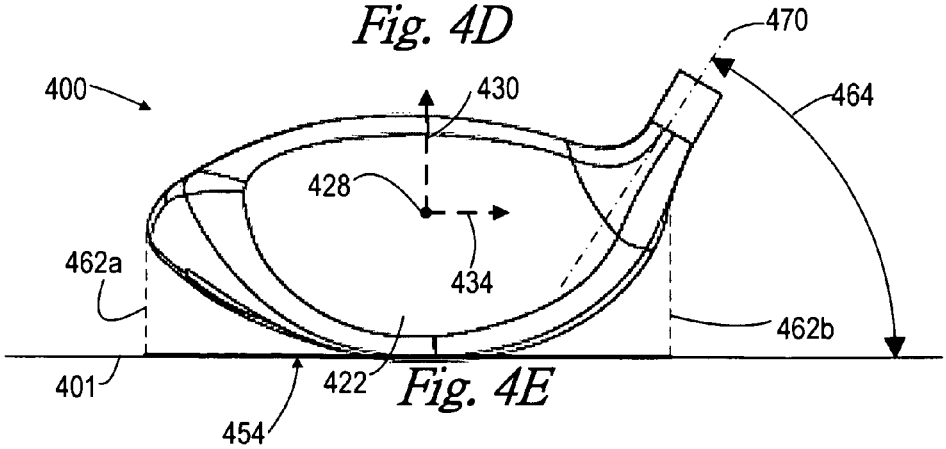
FIG. 4E is an elevated front view of the golf club head of FIG. 4A.

FIG. 4E shows a front view of the club head 400 and striking surface 422 at an address position having a hosel longitudinal axis 470 and angle 464. Again, projection lines 462*a*,462*b* are shown in dashed lines to further illustrate how the crown silhouette 454 is projected on to the ground 401, as previously described.

Figure 5A:
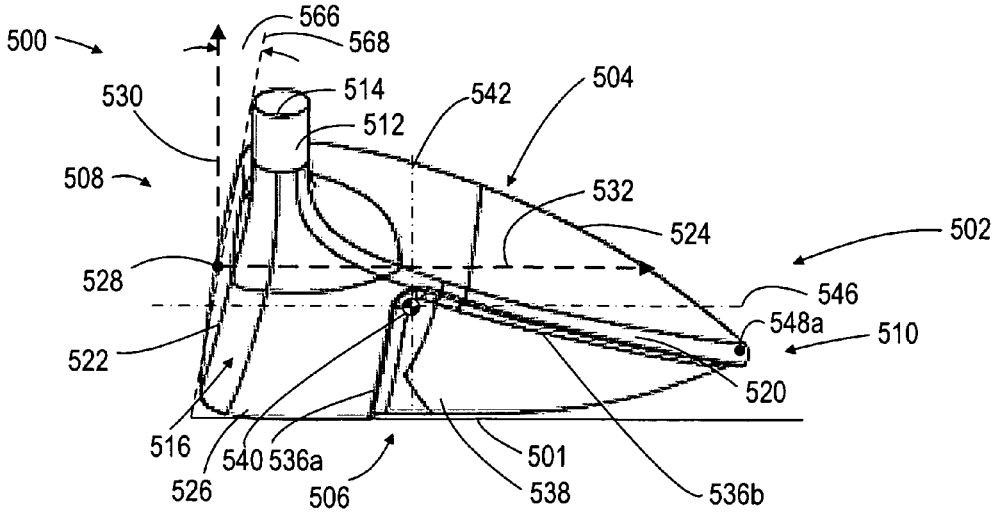
FIG. 5A is an elevated side view of a golf club head showing a golf club head origin coordinate system and a center-of-gravity coordinate system according to a fifth embodiment.

FIG. 5A shows a wood-type (e.g., driver or fairway wood) golf club head 500 including a hollow body 502 having a top portion 504, a bottom portion 506, a front portion 508, and a back portion 510. A hosel 512 which defines a hosel bore 514 is connected with the hollow body 502. The body 502 further includes a heel portion 516 and a toe portion 518.

FIG. 5A further shows a side view of a club head 500 having a side portion 520, a striking surface 522, a crown 524, a first sole 526, an origin point 528, a Z-axis 530, a Y-axis 532, an X-axis 534, a rearward-most point 548*a*, a CG point 540, a CG z-axis 542, a CG x-axis 544, a and a CG y-axis 546, as previously described.

Figure 5B:
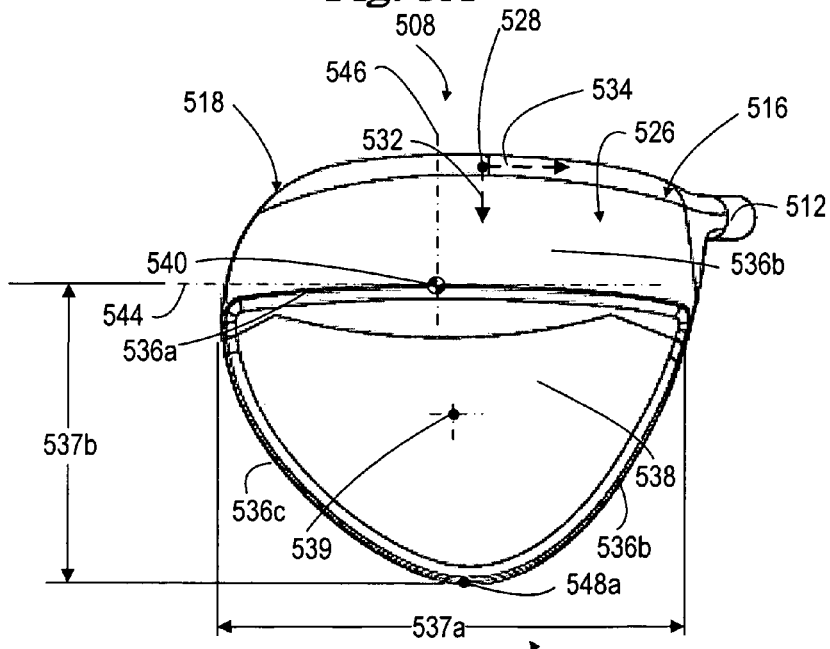
FIG. 5B is a bottom perspective view of the golf club head of FIG. 5A showing the golf club head origin coordinate system and the center-of-gravity coordinate system.

FIG. 5B shows a bottom view having a double sole configuration including a first sole 526 and a second sole 538 located on the bottom portion 506 of the club head 500. In one exemplary embodiment, the second sole 538 creates an indentation 538 having a width 537*a* of about 125 mm in the X-direction 534 and a length 537*b* of about 85 mm in the Y-direction 532. The indentation 538 can have a depth of about 2 to 3 mm below the surface of the first sole 526. Thus, the indentation 538 extends primarily in the X and Y directions.

The second sole 538 is generally defined by three edges 536*a*,536*b*,536*c* around the perimeter of the second sole 538. The first edge 536*a* extends generally parallel to the X-axis 534 between a heel portion 516 and toe portion 518. A second edge 536*b* of the second sole 538 extends from an endpoint of the first edge 536*a* near the heel portion 516 to the rearward-most point 548*a* of the club head 500. A third edge 536*c* of the second sole 538 extends from an endpoint of the first edge 536*a* near the toe portion 518 to the rearward-most point 548*a* of the club head 500. In one embodiment, the second edge 536*b* and third edge 536*c* closely follow a first 556*a* and second 558*b* silhouette contour line discussed in further detail below.

In one exemplary embodiment, the second sole 538 primarily occupies the surface area of the bottom portion 506 from the second sole first edge 536*a* to the rearward-most point 548*a* of the club head 500. The second sole 538 does not extend into the top portion 504 of the club head 500. In other words, the second sole 538 is located on the bottom portion 506 or sole 526 only.

In one embodiment, the second sole 538 removes a total of about 9 cm$^3$ from a total volume of the club head 500 thereby allowing the saved volume to be reallocated in other regions of the club head 500. For example, the first body volume can be about 455 cm$^3$ and have a second body volume after indentation removal of about 464 cm$^3$.

In certain embodiments, the second sole 538 removes about 12 cm$^3$ to about 15 cm$^3$ from the total volume of the club head 500. In other words, the removal of the second sole 538 would increase the volume of the head 500 by about 12 cm$^3$ to about 15 cm$^3$ to create a second body volume. In one embodiment, the second body volume (without the second sole) is about 4-5% larger than the first body volume (with the second sole). In another embodiment, the bottom portion volume is about 54% of the total volume of the club head. The total volume of the club head 500 can be about 462 cm$^3$ and the top portion 504 volume is about 212 cm$^3$ while the bottom portion volume is about 250 cm$^3$.

Figure 5C:
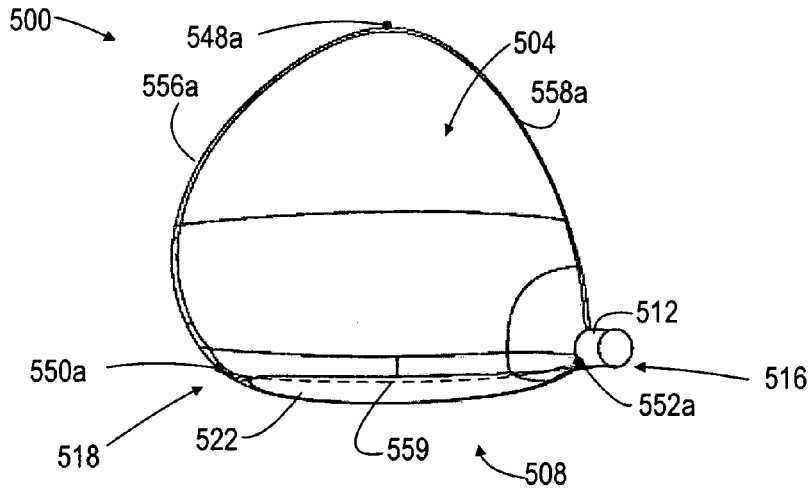
FIG. 5C is a top view of the golf club head of FIG. 5A.

FIG. 5C shows a top view of the club head 500 including the top portion 504, striking surface 522, and the hosel 512. The X-axis 534 and the Y-axis 532 extend from the origin point 528 as previously mentioned. The club head 500 also has a first point 548*a*, a second point 550*a*, and a third point 552*a* located about the perimeter of the top portion 504 as previously described.

Again, a top portion silhouette profile is shown including a first contour 556*a*, a second contour 558*a*, and a third segment 559 is located along a perimeter of the top portion 504 defining the outer bounds of the top portion 504 in substantially an X-direction 534 and Y-direction 532 as previously described. Again, the first contour 556*a*, second contour 558*a*, and third segment 559 are substantially coplanar in one embodiment.

Figure 5D:
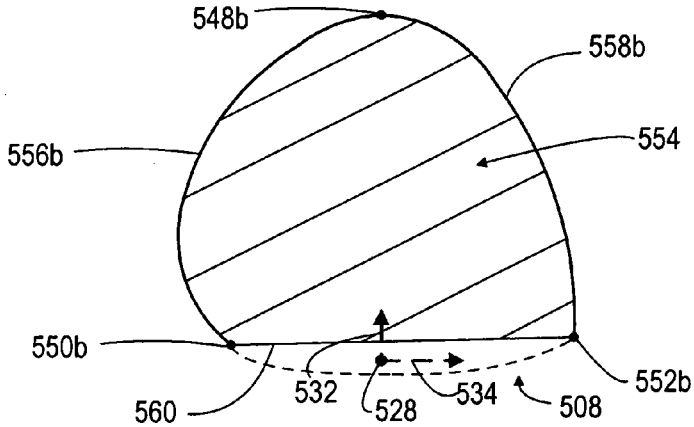
FIG. 5D is a projected crown silhouette of the golf club head in FIG. 5C.

FIG. 5D shows a projected crown silhouette 554 being the top portion silhouette profile shape that is externally projected on to the ground when looking vertically down at the crown 524 when the head 500 is in the address position, as previously described. As noted above, the projected crown silhouette 554 is defined by three projected points 548*b*,550*b*, 552*b* and three segments 556*b*,558*b*,560 shown in an X-Y plane or ground 501 plane. In one embodiment, the projected crown silhouette 554 occupies a projected silhouette area of 12,150 cm$^3$ in an X-Y plane while having a width W, height H, and depth D dimension of about 125 mm, 65 mm, 123 mm, respectively. In addition, a large face size greater than 4,000 mm$^2$ is achieved, such as 4,793 mm$^2$.

Furthermore, the golf club head 500 has a CG with a CG x-axis 534 coordinate, a CG y-axis 532 coordinate, and a CG z-axis 530 coordinate within the ranges described herein.

In one exemplary embodiment, the club head 500 has a moment of inertia about the CG z-axis, $I_{CGz}$, and a moment of inertia about the CG x-axis $I_{CGx}$ that are within the ranges described herein.

In one exemplary embodiment, the top portion 504 surface area $S_t$ is about 17,787 mm$^2$ and the bottom portion 506 surface area $S_b$ including the indentation 538 is about 18,526 mm$^2$ resulting in a total surface area of about 36,313 mm$^2$ and a surface ratio $S_r$ of about 0.96.

Figure 5E:
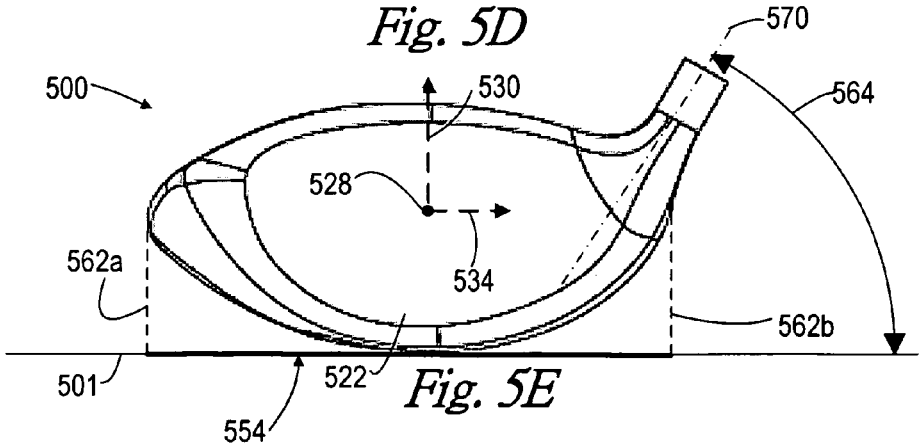
FIG. 5E is an elevated front view of the golf club head of FIG. 5A.

FIG. 5E shows a front view of the club head 500 and striking surface 522 at an address position having a hosel longitudinal axis 570 and angle 564. Again, projection lines 562*a*,562*b* are shown in dashed lines to further illustrate how the crown silhouette 554 is projected on to the ground 501, as previously described.

Figure 6A:
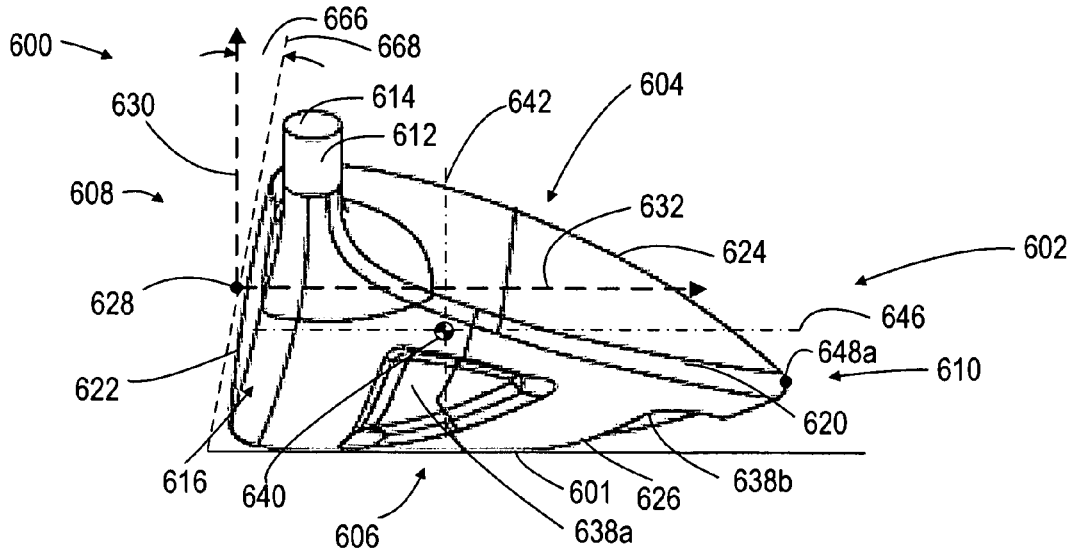
FIG. 6A is an elevated side view of a golf club head showing a golf club head origin coordinate system and a center-of-gravity coordinate system according to a sixth embodiment.

FIG. 6A shows a wood-type (e.g., driver or fairway wood) golf club head 600 including a hollow body 602 having a top portion 604, a bottom portion 606, a front portion 608, and a back portion 610. A hosel 612 which defines a hosel bore 614 is connected with the hollow body 602. The body 602 further includes a heel portion 616 and a toe portion 618.

FIG. 6A further shows a side view of a club head 600 having a side portion 620, a striking surface 622, a crown 624, a sole 626, an origin point 628, a Z-axis 630, a Y-axis 632, an X-axis 634, a rearward-most point 648*a*, a CG point 640, a CG z-axis 642, a CG x-axis 644, a and a CG y-axis 646, as previously described.

Figure 6B:
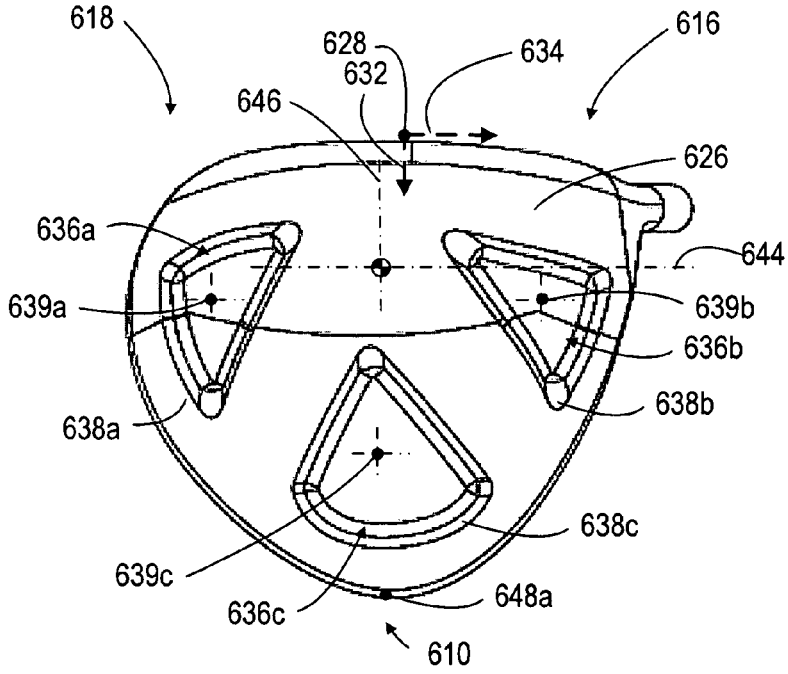
FIG. 6B is a bottom perspective view of the golf club head of FIG. 6A showing the golf club head origin coordinate system and the center-of-gravity coordinate system.

FIG. 6B shows a bottom view having three indentations 638*a*,638*b*,638*c* located on the bottom portion 606 of the club head 600. In one exemplary embodiment, the three indentation 638*a*,638*b*,638*c* create a K-shaped sole 626. The first indentation 638*a* has a wedge shape or triangular shape located near the toe portion 618 and pointing in a rearward direction toward the back portion 610 of the sole 626. The second indentation 638*b* has a wedge shape or triangular shape located near the heel portion 616 and pointing in a rearward direction toward the back portion 610 of the sole 626. The third indentation 638*c* has a wedge shape or triangular shape located near the back portion 610 and pointing in a forward direction toward the front portion 608 of the sole 626. A portion of the third indentation 638*c* can be curved to accommodate the perimeter shape of the sole 626. In one embodiment, the indentations 638*a*,638*b*,638*c* are located on the bottom portion 606 or sole 626 only. The three indentations 638*a*,638*b*,638*c* include three edges that create indentation sidewalls 636*a*,636*b*,636*c* below the surface of the sole 626 into the body 602. In one embodiment, the three indentations 638*a*,638*b*,638*c* are about 6 mm to 8 mm deep below the surface of the sole 626.

In certain embodiments, the indentations 638*a*,638*b*,638*c* remove a total of about 12 $cm^3$ to about 18 $cm^3$ from a total volume of the club head 600 thereby allowing the saved volume to be reallocated in other regions of the club head 600. For example, the first body volume can be about 460 $cm^3$ prior to indentation removal and have a second body volume of about 478 $cm^3$ after indentation removal. In another embodiment, the indentations 638*a*,638*b*,638*c* remove at most about of 15 $cm^3$ from the total volume of the club head 600. In other words, the removal of the indentations 638*a*,638*b*,638*c* can increase the volume of the head 600 by about 15 $cm^3$ to create a second body volume. In one embodiment, the second body volume (without indentations) is about 4-5% larger than the first body volume (with indentations). In another embodiment, the bottom portion volume is about 53% of the total volume of the club head. The top portion 604 can have a volume of about 218 $cm^3$ and the bottom portion can have a volume of about 246 $cm^3$ resulting in a total volume of about 464 $cm^3$.

Figure 6C:
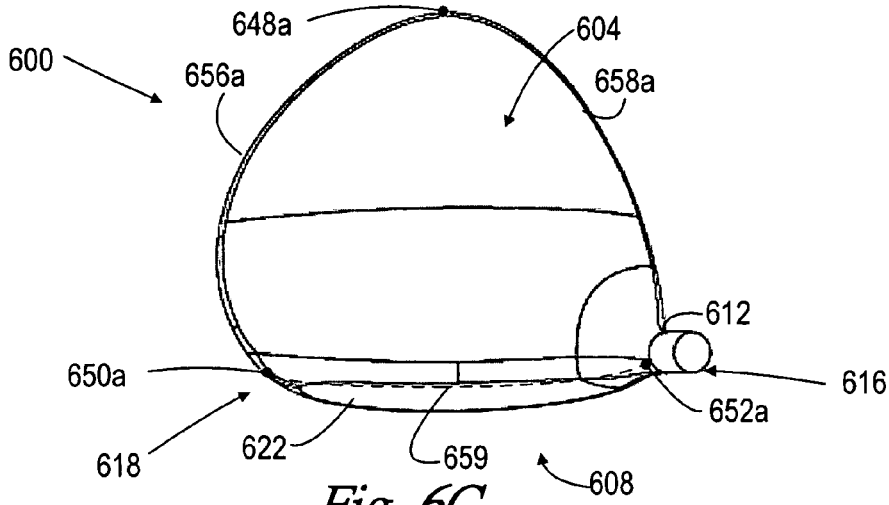
FIG. 6C is a top view of the golf club head of FIG. 6A.

FIG. 6C shows a top view of the club head 600 including the top portion 604, striking surface 622, and the hosel 612. The X-axis 634 and the Y-axis 632 extend from the origin point 628 as previously mentioned. The club head 600 also has a first point 648*a*, a second point 650*a*, and a third point 652*a* located about the perimeter of the top portion 604 as previously described.

Again, a top portion silhouette profile is shown including a first contour 656*a*, a second contour 658*a*, and a third segment 659 is located along a perimeter of the top portion 604 defining the outer bounds of the top portion 604 in substantially an X-direction 634 and Y-direction 632 as previously described. In one embodiment, the first contour 656*a*, second contour 658*a*, and third segment 659 are substantially coplanar in one embodiment.

Figure 6D:
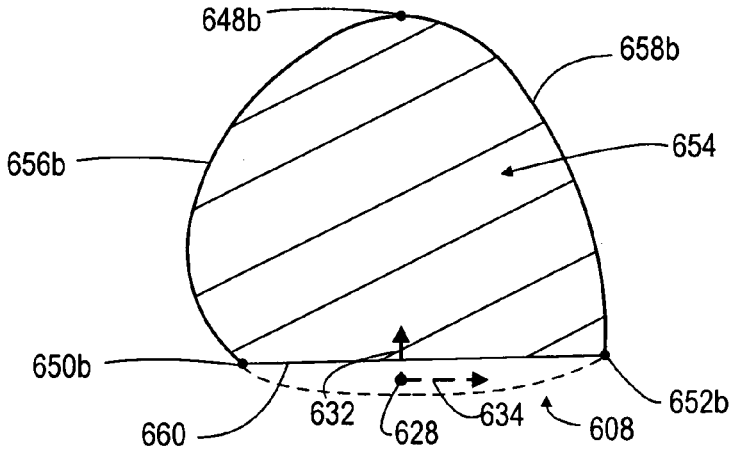
FIG. 6D is a projected crown silhouette of the golf club head in FIG. 6C.

FIG. 6D shows a projected crown silhouette 654 being the top portion silhouette profile shape that is externally projected on to the ground when looking vertically down at the crown 624 when the head 600 is in the address position, as previously described. As noted above, the projected crown silhouette 654 is defined by three projected points 648*b*,650*b*, 652*b* and three segments 656*b*,658*b*,660 shown in an X-Y plane or ground 601 plane. In one embodiment, the projected crown silhouette 654 occupies a projected silhouette area of about 12,139 $mm^2$ in an X-Y plane while having a width W, height H, and depth D dimension of about 125 mm, 65 mm, and 123 mm, respectively. In addition, the striking surface 622 face size can be about 4,793 $mm^2$.

Furthermore, the golf club head 600 has a CG with a CG x-axis 634 coordinate, a CG y-axis 632 coordinate, and a CG z-axis 630 coordinate within the ranges described herein.

In one exemplary embodiment, the club head 600 has a moment of inertia about the CG z-axis, $I_{CGz}$, and a moment of inertia about the CG x-axis $I_{CGx}$ within the ranges described herein.

In one exemplary embodiment, the top portion 604 surface area $S_t$ is about 17,947 $mm^2$ and the bottom portion 606 surface area $S_b$ including the indentation 638 is about 19,353 $mm^2$ resulting in a total surface area of about 37,301 17,947 $mm^2$ and a surface ratio $S_r$ of about 0.93.

Figure 6E:
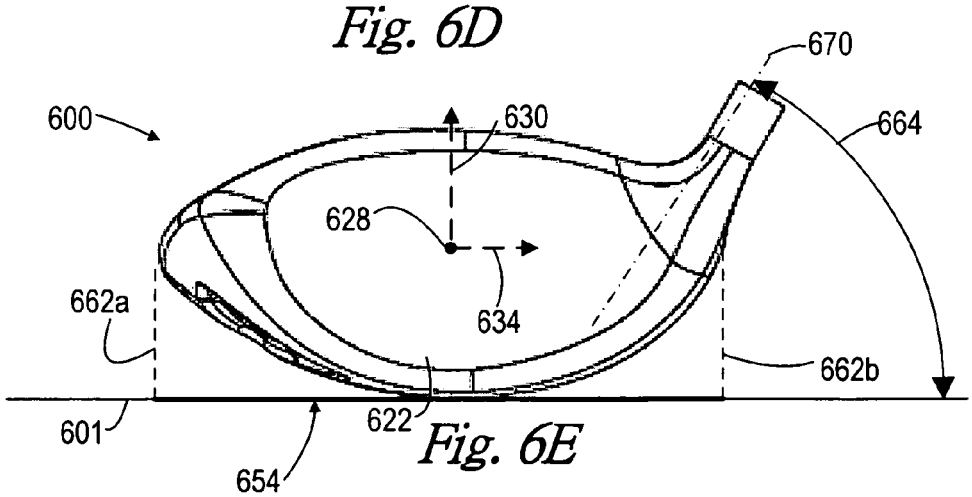
FIG. 6E is an elevated front view of the golf club head of FIG. 6A.

FIG. 6E shows a front view of the club head 600 and striking surface 622 at an address position having a hosel longitudinal axis 670 and angle 664. Again, projection lines 662*a*,662*b* are shown in dashed lines to further illustrate how the crown silhouette is projected on to the ground 601, as previously described.

Figure 7A:
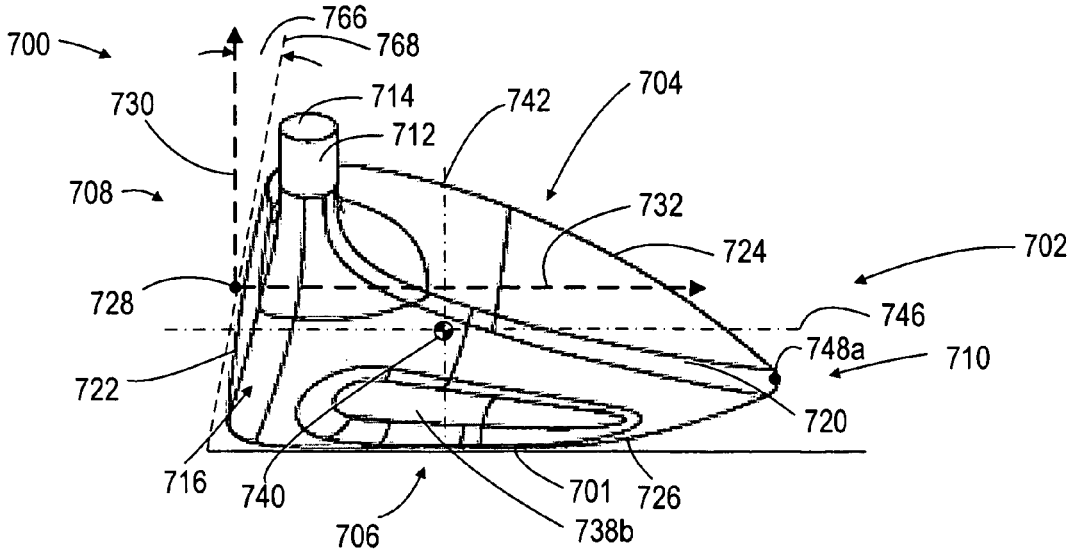
FIG. 7A is an elevated side view of a golf club head showing a golf club head origin coordinate system and a center-of-gravity coordinate system according to a seventh embodiment.

FIG. 7A shows a wood-type (e.g., driver or fairway wood) golf club head 700 including a hollow body 702 having a top portion 704, a bottom portion 706, a front portion 708, and a back portion 710. A hosel 712 which defines a hosel bore 714 is connected with the hollow body 702. The body 702 further includes a heel portion 716 and a toe portion 718.

FIG. 7A further shows a side view of a club head 700 having a side portion 720, a striking surface 722, a crown 724, a sole 726, an origin point 728, a Z-axis 730, a Y-axis 732, an X-axis 734, a rearward-most point 748*a*, a CG point 740, a CG z-axis 742, a CG x-axis 744, a and a CG y-axis 746, as previously described.

Figure 7B:
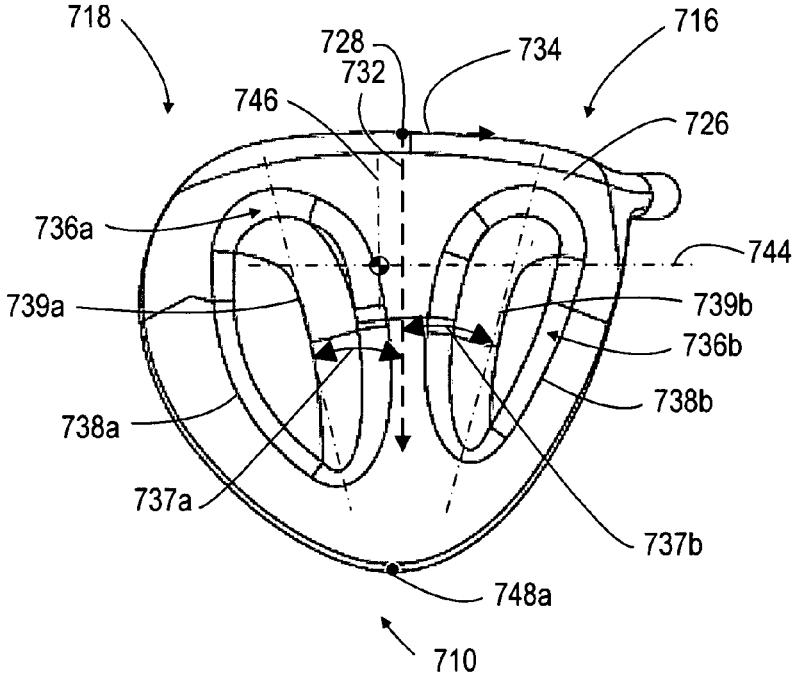
FIG. 7B is a bottom perspective view of the golf club head of FIG. 7A showing the golf club head origin coordinate system and the center-of-gravity coordinate system.

FIG. 7B shows a bottom view of the bottom portion 706 having a first indentation 738*a* and a second indentation 738*b* located on the bottom portion 706 of the club head 700. The first indentation 738*a* is located near the toe portion 718 and the second indentation 738*b* is located near the heel portion 716. In one exemplary embodiment, the first 738*a* and second 738*b* indentation are an egg shape or tear dropped shape having side walls 736*a*,736*b* that extend below the surface of the sole 726 into the body 702. It is understood that the indentations 738*a*,738*b* can be an elliptical shape. The first 738*a* and second 738*b* indentation are positioned in a V-shaped arrangement where the end points of the indentations 738*a*,738*b* are closer together near the back portion 710 of the club head when compared to the opposite end points of the indentations near the front portion 708.

In addition, the first indention 738*a* has a major axis 739*a* and the second indentation has a second major axis 739*b* that form a first angle 737*a* and a second angle 737*b* with the Y-axis 732, respectively. Thus, the indentations 738*a*,738*b* extend primarily in the Y-direction 732. In one exemplary embodiment, the first indentation 738*a* is slightly larger in size than the second indentation 738*b*, and the indentations 738*a*,738*b* are exclusively located on the bottom portion 706 or sole 726 only. Furthermore, each indentation 738*a*,738*b* can have a maximum Y-direction 732 dimension of about 75 mm, a maximum X-direction 734 dimension of about 40 mm, and a maximum depth of about 7 mm to about 9 mm below the surface of the sole 726.

In certain embodiments, the indentation 738 removes a total of about 12 $cm^3$ to about 15 $cm^3$ from a total volume of the club head 700 thereby allowing the saved volume to be reallocated in other regions of the club head 700. In one embodiment, the indentation 738 removes about 12 $cm^3$ from the total volume of the club head 700. In other words, the removal of the indentation 738 would increase the volume of the head 700 by about 12 $cm^3$ to create a second body volume. For example, the first body volume can be about 457 $cm^3$ and the second body volume can be about 469 $cm^3$ after indentation removal. In one embodiment, the second body volume (without indentations) is about 4-5% larger than the first body volume (with indentations). In another embodiment, the bottom portion volume is about 54% of the total volume of the club head. Furthermore, the top portion is about 214 $cm^3$ and the bottom portion is about 249 $cm^3$ resulting in a total volume of about 463 $cm^3$.

Figure 7C:
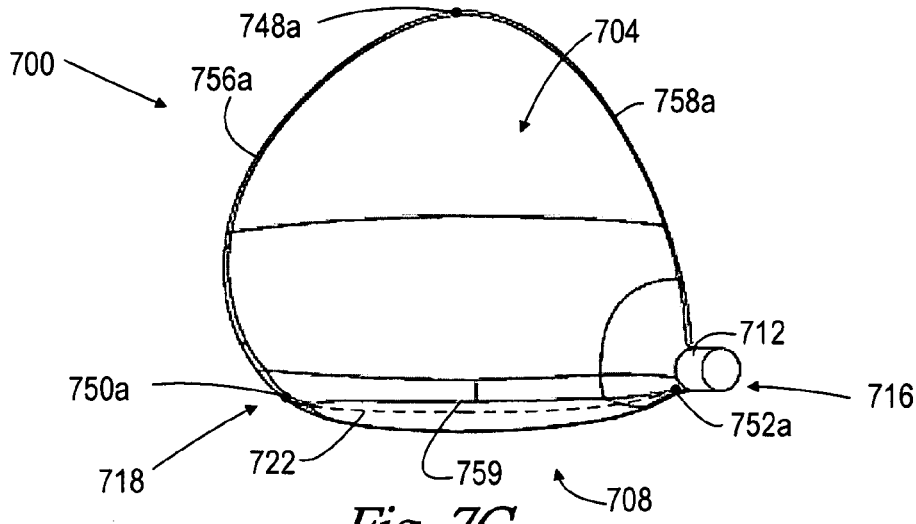
FIG. 7C is a top view of the golf club head of FIG. 7A.

FIG. 7C shows a top view of the club head 700 including the top portion 704, striking surface 722, and the hosel 712. The X-axis 734 and the Y-axis 732 extend from the origin point 728 as previously mentioned. The club head 700 also has a first point 748*a*, a second point 750*a*, and a third point 752*a* located about the perimeter of the top portion 704 as previously described.

Again, a top portion silhouette profile is shown including a first contour 756*a*, a second contour 758*a*, and a third segment 759 is located along a perimeter of the top portion 704 defining the outer bounds of the top portion 704 in substantially an X-direction 734 and Y-direction 732 as previously described. Again, the first contour 756*a*, second contour 758*a*, and third segment 759 are substantially coplanar in one embodiment.

Figure 7D:
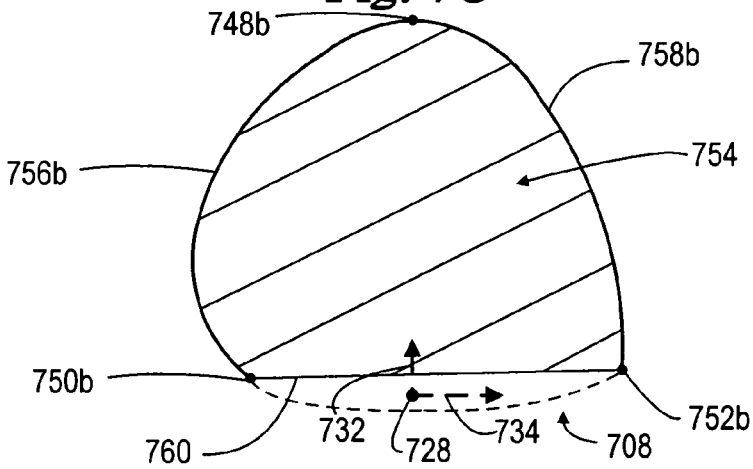
FIG. 7D is a projected crown silhouette of the golf club head in FIG. 7C.

FIG. 7D shows a projected crown silhouette 754 being the top portion silhouette profile shape that is externally projected on to the ground when looking vertically down at the crown 724 when the head 700 is in the address position, as previously described. As noted above, the projected crown silhouette 754 is defined by three projected points 748*b*,750*b*, 752*b* and three segments 756*b*,758*b*,760 shown in an X-Y plane or ground 701 plane. In one embodiment, the projected crown silhouette 754 occupies a projected silhouette area of about 11,977 $mm^2$ in an X-Y plane while having a width W, height H, and depth D dimension of about 126 mm, 65 mm, and 123 mm, respectively. Furthermore, the face size is about 4,793 $mm^2$.

In addition, the golf club head 750 has a CG with a CG x-axis 734 coordinate, a CG y-axis 732 coordinate, and a CG z-axis 730 coordinate within the ranges described herein.

Furthermore, the club head 700 has a moment of inertia about the CG z-axis, $I_{CGz}$, and a moment of inertia about the CG x-axis $I_{CGx}$ within the ranges described herein.

In one exemplary embodiment, the top portion 704 surface area $S_t$ is about 17,869 $mm^2$ and the bottom portion 706 surface area $S_b$ including the indentation 738 is about 18,818 $mm^2$ resulting in a total surface area of about 36,687 $mm^2$ and a surface ratio $S_r$ of about 0.95.

Figure 7E:
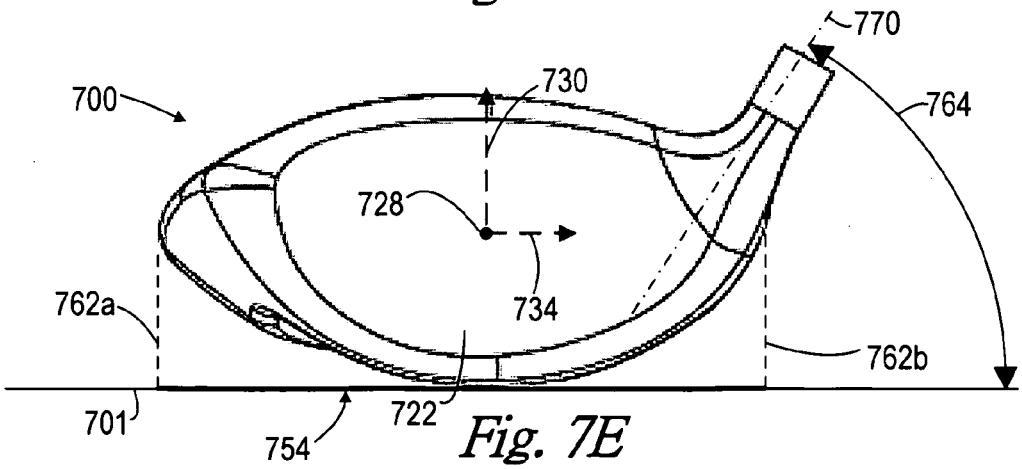
FIG. 7E is an elevated front view of the golf club head of FIG. 7A.

FIG. 7E shows a front view of the club head 700 and striking surface 722 at an address position having a hosel longitudinal axis 770 and angle 764. Again, projection lines 762*a*,762*b* are shown in dashed lines to further illustrate how the crown silhouette is projected on to the ground 701, as previously described.

Figure 8A:
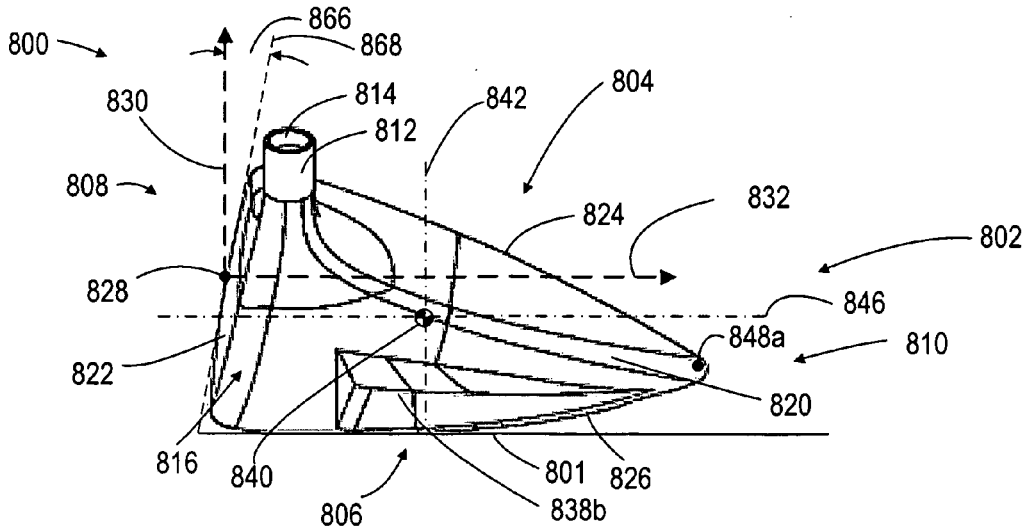
FIG. 8A is an elevated side view of a golf club head showing a golf club head origin coordinate system and a center-of-gravity coordinate system according to an eighth embodiment.

FIG. 8A shows a wood-type (e.g., driver or fairway wood) golf club head 800 including a hollow body 802 having a top portion 804, a bottom portion 806, a front portion 808, and a back portion 810. A hosel 812 which defines a hosel bore 814 is connected with the hollow body 802. The body 802 further includes a heel portion 816 and a toe portion 818.

FIG. 8A further shows a side view of a club head 800 having a side portion 820, a striking surface 822, a crown 824, a sole 826, an origin point 828, a Z-axis 830, a Y-axis 832, an X-axis 834, a rearward-most point 848*a*, a CG point 840, a CG z-axis 842, a CG x-axis 844, a and a CG y-axis 846, as previously described.

Figure 8B:
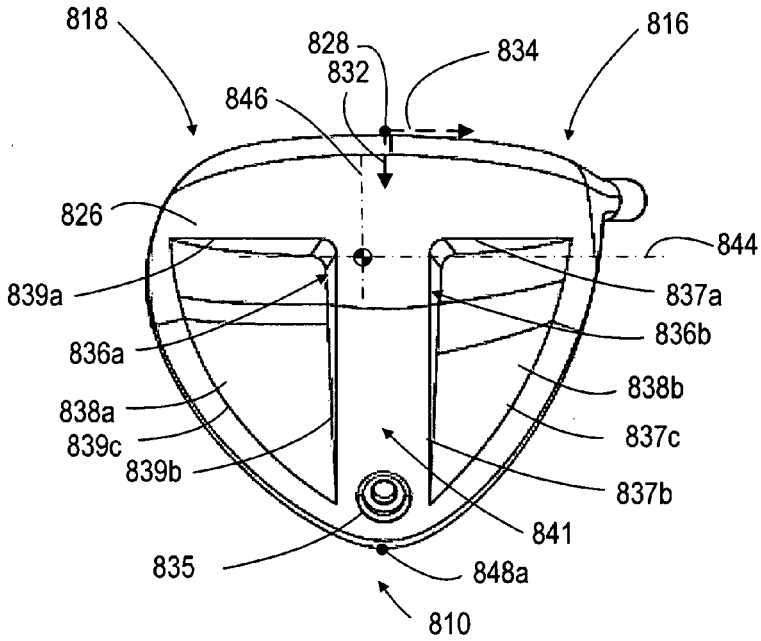
FIG. 8B is a bottom perspective view of the golf club head of FIG. 8A showing the golf club head origin coordinate system and the center-of-gravity coordinate system.

FIG. 8B shows a bottom view of the bottom portion 806 having a first indentation 838*a* and a second indentation 838*b* located on the bottom portion 806 of the club head 800. The first indentation 838*a* is located near the toe portion 818 and the second indentation 838*b* is located near the heel portion 816. In one exemplary embodiment, the first 838*a* and second 838*b* indentation are triangular in shape and arranged so that the sole 826 forms a T-shape. In one embodiment, the first 838*a* and second 838*b* indentation are mirrored across the Y-axis 832 and are about the same shape and size. In one embodiment, the indentations 838*a*,838*b* each have a maximum X-direction 834 dimension of about 55 mm and a maximum Y-direction 832 dimension of about 85 mm and a maximum depth of about 9 mm to about 12 mm.

The first indentation 838*a* has a first edge 839*a*, a second edge 839*b*, and a third edge 839*c*. The second indentation 838*b* has a first edge 837*a*, a second edge 837*b*, and a third edge 837*c*. The first edges 839*a*,837*a* of both indentations extend in an X-direction and are generally parallel with the X-axis 834. The second edges 839*b*,837*b* of both indentations extend in a Y-direction and are generally parallel with the Y-axis 832. In one embodiment, the first 839*a*,837*a* and second edges 839*b*,837*b* of both indentations create a side wall 836*a*,836*b* that extends below the surface of the sole 826 and into the body 802.

The third edge 839*c* of the first indentation 838*a* is a curved edge in the X-Y plane that generally follows a silhouette profile near the toe side 818 of the club head 800. The third edge 837*c* of the second indentation 838*b* is also a curved edge in the X-Y plane that generally follows a silhouette profile near the heel side 819 of the club head 800. In one embodiment, the third edges 839*c*,837*c* of both indentations do not create a side wall below the surface of the sole 826.

The first 838*a* and second 838*b* indentations are separated by a plateau or center sole portion 841 that extends in a direction parallel to the Y-axis 832. In one embodiment, the plateau or center sole portion 841 is about 25 mm to about 35 mm wide. The center sole portion 841 also contains a movable weight port 835 located on the sole 826 near the back portion 810 where a movable weight may be inserted or removed to change characteristics of the CG location. In certain embodiments, a movable weight system is implemented as described in U.S. patent application Ser. Nos. 10/290,817 (U.S. Pat. No. 6,773,360), 10/785,692 (U.S. Pat. No. 7,166,040), 11/025,469, 11/067,475 (U.S. Pat. No. 7,186,190), 11/066,720 (U.S. Pat. No. 7,407,447), and 11/065,772 (U.S. Pat. No. 7,419,441), which are hereby incorporated by reference in their entirety.

In certain embodiments, the indentations 838*a*,838*b* remove a total of about 12 $cm^3$ to about 16 $cm^3$ from a total volume of the club head 800 thereby allowing the saved volume to be reallocated in other regions of the club head 800. In one embodiment, the indentations 838*a*,838*b* remove about of 15 $cm^3$ from the total volume of the club head 800. For example, the first body volume can be about 458 $cm^3$ before indentation removal and about 473 $cm^3$ after indentation removal. In other words, the removal of the indentations 838*a*,838*b* would increase the volume of the head 800 by about 15 $cm^3$ to create a second body volume. In one embodiment, the second body volume (without indentations) is about 4-5% larger than the first body volume (with indentations). In another embodiment, the bottom portion volume is about 60% of the total volume of the club head. For example, the top portion volume can be about 185 $cm^3$ while the bottom portion has a volume is about 277 $cm^3$ for a total volume of about 462 $cm^3$.

Figure 8C:
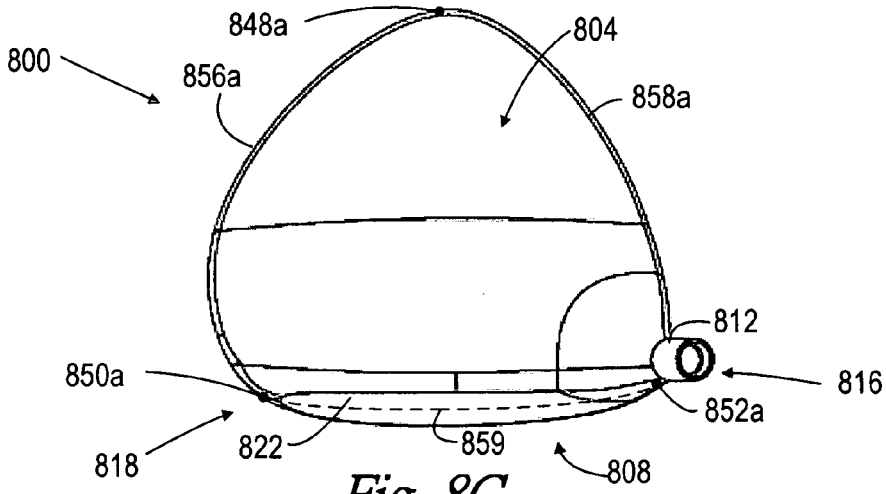
FIG. 8C is a top view of the golf club head of FIG. 8A.

FIG. 8C shows a top view of the club head 800 including the top portion 804, striking surface 822, and the hosel 812. The X-axis 834 and the Y-axis 832 extend from the origin point 828 as previously mentioned. The club head 800 also has a first point 848*a*, a second point 850*a*, and a third point 852*a* located about the perimeter of the top portion 804 as previously described.

Again, a top portion silhouette profile is shown including a first contour 856*a*, a second contour 858*a*, and a third segment 859 is located along a perimeter of the top portion 804 defining the outer bounds of the top portion 804 in substantially an X-direction 834 and Y-direction 832 as previously described. Again, the first contour 856*a*, second contour 858*a*, and third segment 859 are substantially coplanar in one embodiment.

Figure 8D:
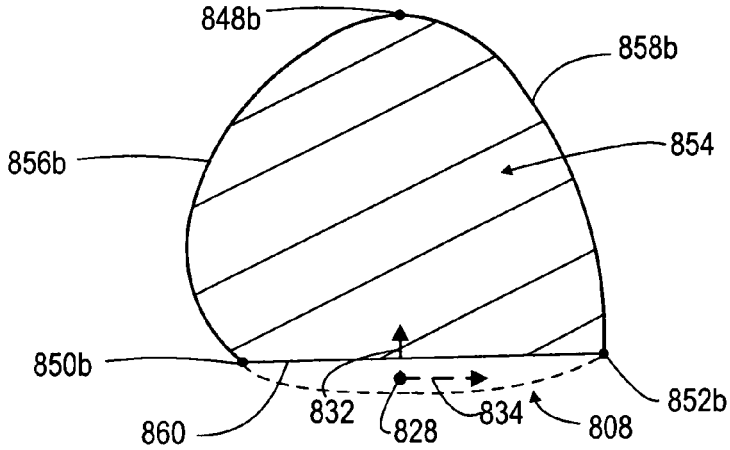
FIG. 8D is a projected crown silhouette of the golf club head in FIG. 8C.

FIG. 8D shows a projected crown silhouette 854 being the top portion silhouette profile shape that is externally projected on to the ground when looking vertically down at the crown 824 when the head 800 is in the address position, as previously described. As noted above, the projected crown silhouette 854 is defined by three projected points 848*b*,850*b*, 852*b* and three segments 856*b*,858*b*,860 shown in an X-Y plane or ground 801 plane. In one embodiment, the projected crown silhouette 854 occupies a silhouette area of 11,919 $mm^2$ in an X-Y plane while having a width W, height H, and depth D dimension of about 126 mm, 70 mm, and 125 mm, respectively. In addition, a face size or striking surface area, in one embodiment, is about 5,632 $mm^2$, according to the striking surface area measurement procedure, as previously described.

Furthermore, the golf club head 850 has a CG with a CG x-axis 834 coordinate, a CG y-axis 832 coordinate, and a CG z-axis 830 coordinate within the ranges described herein.

In certain embodiments, the club head 800 has a moment of inertia about the CG z-axis, $I_{CGz}$, and a moment of inertia about the CG x-axis $I_{CGx}$ within the range described herein.

In one exemplary embodiment, the top portion 804 surface area $S_t$ is about 17,798 $mm^2$ and the bottom portion 806 surface area $S_b$ including the indentation 838 is about 20,421 $mm^2$ resulting in a total surface area of about 38,219 $mm^2$ and a surface ratio $S_r$ of about 0.87.

Figure 8E:
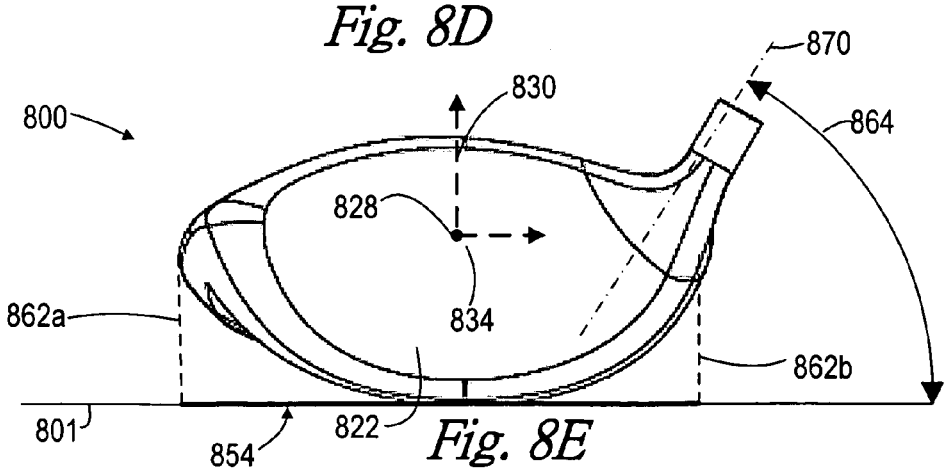
FIG. 8E is an elevated front view of the golf club head of FIG. 8A.

FIG. 8E shows a front view of the club head 800 and striking surface 822 at an address position having a hosel longitudinal axis 870 and angle 864. Again, projection lines 862*a*,862*b* are shown in dashed lines to further illustrate how the crown silhouette 854 is projected on to the ground 801, as previously described.

Figure 9A:
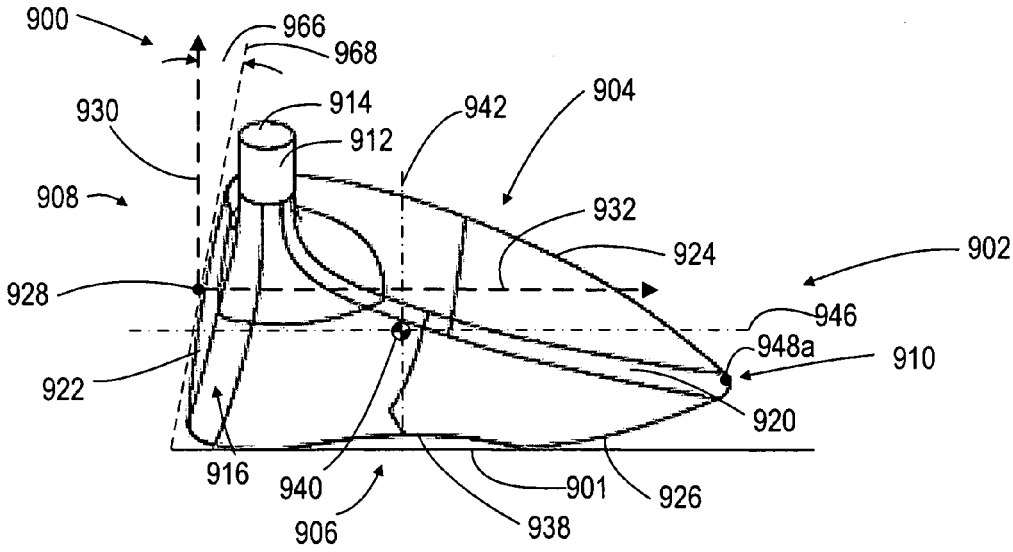
FIG. 9A is an elevated side view of a golf club head showing a golf club head origin coordinate system and a center-of-gravity coordinate system according to a ninth embodiment.

FIG. 9A shows a wood-type (e.g., driver or fairway wood) golf club head 900 including a hollow body 902 having a top portion 904, a bottom portion 906, a front portion 908, and a back portion 910. A hosel 912 which defines a hosel bore 914 is connected with the hollow body 902. The body 902 further includes a heel portion 916 and a toe portion 918.

FIG. 9A further shows a side view of a club head 900 having a side portion 920, a striking surface 922, a crown 924, a sole 926, an origin point 928, a Z-axis 930, a Y-axis 932, an X-axis 934, a rearward-most point 948*a*, a CG point 940, a CG z-axis 942, a CG x-axis 944, a and a CG y-axis 946, as previously described.

Figure 9B:
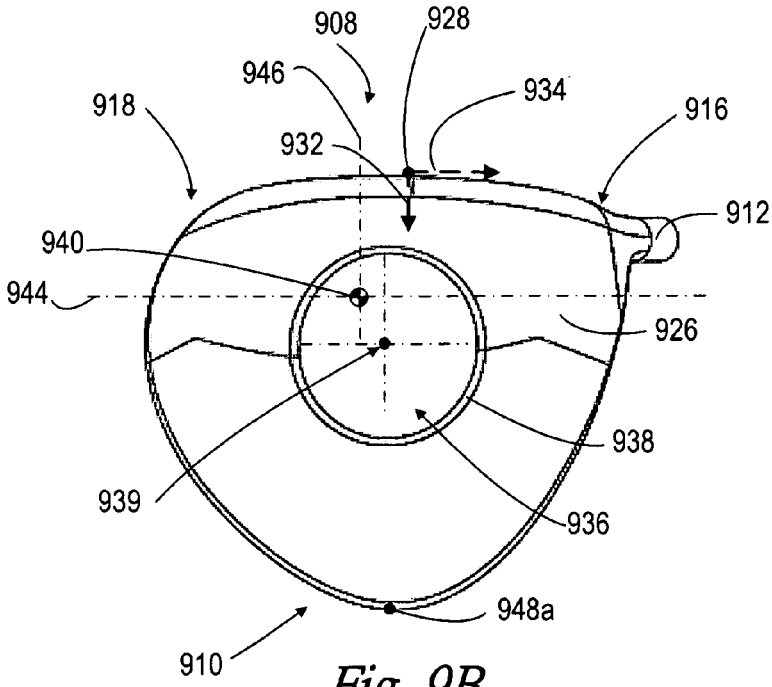
FIG. 9B is a bottom perspective view of the golf club head of FIG. 9A showing the golf club head origin coordinate system and the center-of-gravity coordinate system.

FIG. 9B shows a single dimple or small indentation 938 being located on the sole 926 in the bottom portion 906 of the club head 900. The bottom portion 906 extends substantially in an X and Y direction along the X-axis 934 and the Y-axis 932.

It is understood that the single indentation 938 can be located anywhere on the bottom portion 906. In one embodiment, the single indentation 938 is positioned on the bottom portion 906 between the heel 916 and toe 918 along the X-axis 934. The single indentation 938 is also positioned between the striking surface 922 and a rearward-most point 948*a* located along the Y-axis 932. In one embodiment, the single indentation 938 is a circular or an elliptical shaped indentation that is centrally located on the bottom portion 906 of the club head 900. The single indentation 938 includes a concave surface 936 extending below the top surface of the bottom portion 906 into the body 902. A center point 939 of the single indentation 938 is located about 48 mm from the origin point 928 and has a diameter of about 50 mm.

In certain embodiments, removal of the indentation 938 would increase the volume of the head 900 by about 12 $cm^3$ to about 22 $cm^3$. In one embodiment, the presence of the indentation 938 removes about 15 $cm^3$ from the bottom portion 906 allowing the saved volume to be reallocated in other regions of the club head, such as the top portion 904 or crown area 924. In one exemplary embodiment, a second body volume (without indentations) is about 4-5% larger than the first body volume (with indentations). In another embodiment, the bottom portion volume is about 55% of the total volume. For example, an embodiment having a 22 $cm^3$ indentation has a top portion volume of about 201 $cm^3$ and a bottom portion volume of about 248 $cm^3$ resulting in a total volume of about 449 $cm^3$.

Figure 9C:
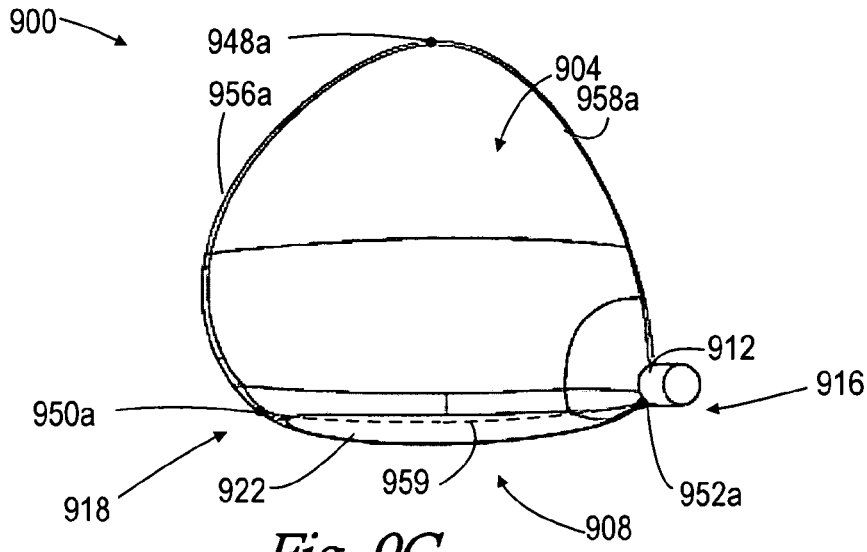
FIG. 9C is a top view of the golf club head of FIG. 9A.

FIG. 9C shows a top view of the club head 900 including the top portion 904, striking surface 922, and the hosel 912. The X-axis 934 and the Y-axis 932 extend from the origin point 928 as previously mentioned. The club head 900 also has a first point 948*a*, a second point 950*a*, and a third point 952*a* located about the perimeter of the top portion 904 as previously described.

Again, a top portion silhouette profile is shown including a first contour 956*a*, a second contour 958*a*, and a third segment 959 is located along a perimeter of the top portion 904 defining the outer bounds of the top portion 904 in substantially an X-direction 934 and Y-direction 932 as previously described. Again, the first contour 956*a*, second contour 958*a*, and third segment 959 are substantially coplanar in one embodiment.

Figure 9D:
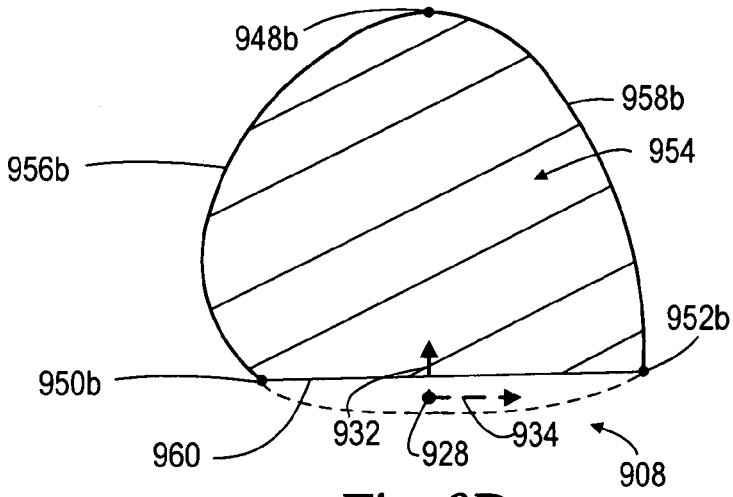
FIG. 9D is a projected crown silhouette of the golf club head in FIG. 9C.

FIG. 9D shows a projected crown silhouette 954 being the crown top view profile shape as the external projected profile of the crown on to the ground 901 when looking vertically down at the crown 924 when the head 900 is in the address position, as previously described. As noted above, the projected crown silhouette 954 is defined by three projected points 948*b*,950*b*,952*b* and three segments 956*b*,958*b*,960 shown in an X-Y plane or ground 901 plane. In one embodiment, the projected crown silhouette 954 occupies a silhouette area of 11,913 $mm^2$ in an X-Y plane while having a width W, height H, and depth D dimension of 125 mm, 65 mm, and 123 mm, respectively. In addition the face size achieved is about 4,793 $mm^2$.

Furthermore, the golf club head 950 has a CG with a CG x-axis 934 coordinate, a CG y-axis 932 coordinate, and a CG z-axis 930 coordinate within the ranges described herein.

In one exemplary embodiment, the club head 900 has a moment of inertia about the CG z-axis, $I_{CGz}$, and a moment of inertia about the CG x-axis $I_{CGx}$ according to the ranges described herein.

In one exemplary embodiment, the top portion 904 surface area $S_t$ is about 17,530 $mm^2$ and the bottom portion 906 surface area $S_b$ including the indentation 938 is about 19,660 $mm^2$ resulting in a total surface area of about 37,191 $mm^2$ and a surface ratio $S_r$ of about 0.89.

Figure 9E:
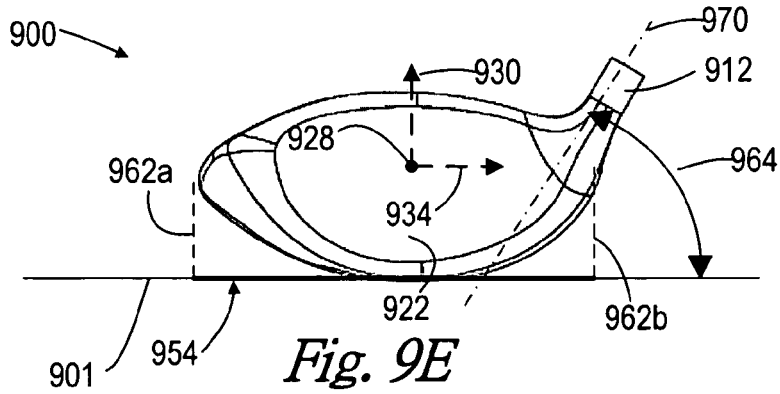
FIG. 9E is an elevated front view of the golf club head of FIG. 9A.

FIG. 9E shows a front view of the club head 900 and striking surface 922 at an address position having a hosel longitudinal axis 970 and angle 964. Again, projection lines 962*a*,962*b* are shown in dashed lines to further illustrate how the crown silhouette 954 is projected on to the ground 901, as previously described.

In all of the embodiments described herein, the ball striking surface can have a maximum height H value of about 67 mm to about 71 mm, a maximum width W value of about 118 mm to about 127 mm and a corresponding ball striking surface area of about 4,000 $mm^2$ to about 8,875 $mm^2$. In certain embodiment, a striking surface are of about 4,000 $mm^2$ to about 6,500 $mm^2$ is preferred. A maximum club head depth value D of about 118 mm to about 127 mm is also possible with a preferred depth D of about 122 mm to about 126 mm. Furthermore, the embodiments described herein show a range of indentation volumes between from about 9 $cm^3$ to about 22 $cm^3$ with a preferred range of about 12 $cm^3$ to about 15 $cm^3$.

Moreover, club head sizes described herein can be within a range of about 400 $cm^3$ to about 470 $cm^3$ with a preferred range of about 460 $cm^3$ to about 470 $cm^3$. The first body volume described herein is within a range of about 440 $cm^3$ to about 465 $cm^3$ and the second body volume is within a range of about 460 $cm^3$ to about 480 $cm^3$. The moments of inertia of the embodiments described herein have a club head with a center of gravity with an x-axis coordinate between about −2 mm and about 7 mm, a y-axis coordinate between about 30 mm and about 40 mm, and a z-axis coordinate between about −7 mm and about 2 mm.

A bottom portion volume percentage of the total club volume of the embodiments described herein are about 50% to about 75% with a preferred range of about 53% to about 72% or greater than 60%.

In use, the embodiments of the present invention create a large crown silhouette profile with a high moment of inertia and a low center of gravity by reducing a bottom portion volume. The embodiments described herein can also have various crown silhouette profile areas of greater than about 11,000 $mm^2$ and within the range of about 11,700 $mm^2$ to about 14,000 $mm^2$. As a result of reducing the bottom portion volume, the surface area of the bottom portion is increased while improving the crown silhouette profile. Thus, the crown silhouette profile is close to the maximum USGA dimension and volume requirements without having a significantly triangular crown silhouette profile shape.

At least one key advantage of the present invention is that a reduction in the sole portion volume of a club head enables a maximum height, width, depth, and face size dimension to be achieved.

In addition, the indentations located on the bottom portion of the club head can be positioned or configured to achieve a certain sound frequency upon direct impact with a golf ball while maintaining club head dimensions.

Furthermore, another advantage of the present invention, is that the reallocation of volume in the club head still achieves a low CG (i.e. at least 2 mm below center-face and at least 15 mm aft of a hosel axis) in order to achieve a high launch angle, low spin trajectory for maximum distance. In one embodiment, the CG is at least 18 mm aft of a hosel axis. Another advantage of the present invention is that the moment of inertia about the vertical axis CG z-axis ($I_{CGz}$) is greater than about 500 kg·$mm^2$ and the moment of inertia about the heel-toe axis CG x-axis ($I_{CGx}$) is greater than about 300 kg·$mm^2$ plus a test tolerance of 10 kg·$mm^2$.

At least one advantage of the present invention is that a more non-triangular shaped head can be achieved as the face size approaches a maximum limit (127 mm by 71.12 mm) and the front-to-back dimension approaches the maximum value (127 mm). Because the shape of the club head can be a more non-triangular shape, alignment properties of the golf club head are improved. In general, as volume is removed from the sole and reallocated, no significant degradation of other properties in the head such as sound, durability, CG, or MOI are observed. The cost of producing the low volume sole design club head is implemented with minimal cost impact.

Another advantage of the present invention is that a relatively high coefficient of restitution (COR) can be maintained. The COR measured in accordance with the U.S.G.A. Rule 4-1a is greater than 0.810 in the embodiments described herein.

In view of the many possible embodiments to which the principles of the disclosed invention may be applied, it should be recognized that the illustrated embodiments are only preferred examples of the invention and should not be taken as limiting the scope of the invention. It will be evident that various modifications may be made thereto without departing from the broader spirit and scope of the invention as set forth. The specification and drawings are, accordingly, to be regarded in an illustrative sense rather than a restrictive sense.

What is claimed is:

1. A golf club head comprising:

a body including an exterior surface defining a first body volume of at most about 470 $cm^3$, the body having a bottom portion, a top portion, a front portion, and a back portion;

a face coupled to the front portion of the body, the face being configured to receive an impact;

a top portion silhouette profile located along a perimeter of the top portion, the top portion silhouette profile defining the outermost bounds of the top portion and the body in an X-direction and a Y-direction and defining an area of at least about 11,000 $mm^2$ when projected onto an X-Y plane; and at least one indentation located on the bottom portion below the top portion silhouette profile, wherein the removal of the at least one indentation from the bottom portion creates a second body volume that is at least 12 $cm^3$ larger than the first body volume;

wherein the top portion silhouette profile is generally triangular and includes a first vertex defining the rearwardmost point of the body, a second vertex defining an intersection between the front portion of the body and a portion of the face nearest to a toe of the golf club head, a third vertex defining an intersection between the front portion of the body and a portion of the face nearest to a heel of the golf club head, a first contour connecting the first and second vertexes, a second contour connecting the first and third vertexes, and a straight segment connecting the second and third vertexes.

2. The golf club head of claim 1, wherein the first body volume is about 440 $cm^3$ to about 470 $cm^3$.

3. The golf club head of claim 1, wherein the first body volume is about 450 $cm^3$ to about 470 $cm^3$.

4. The golf club head of claim 1, wherein the first body volume is about 460 $cm^3$ to about 470 $cm^3$.

5. The golf club head of claim 1, wherein the first body volume is about 460 $cm^3$ to about 470 $cm^3$ and the second body volume is at least about 14 $cm^3$ larger than the first body volume.

6. The golf club head of claim 1, wherein the face has an area of at least about 4,000 $mm^2$.

7. The golf club head of claim 6, wherein a heel-toe dimension is between about 119 mm and about 127 mm.

8. The golf club head of claim 6, wherein a top-bottom dimension is between about 63 mm and about 71 mm.

9. The golf club head of claim 6, wherein a front-back dimension is between about 111 mm and about 127 mm.

10. The golf club head of claim 1, wherein the golf club head has a coefficient of restitution greater than about 0.810.

11. The golf club head of claim 1, wherein the golf club head has a moment of inertia about a head center of gravity z-axis of at least about 500 $kg \cdot mm^2$.

12. The golf club head of claim 1, wherein the golf club head has a moment of inertia about a head center of gravity x-axis of at least about 300 $kg \cdot mm^2$.

13. The golf club head of claim 1, wherein the golf club head has a head origin defined as a position on the face plane at a geometric center of the face, the head origin including an x-axis tangential to the face and generally parallel to the ground when the head is in an address position where a positive x-axis extends towards the heel portion, a y-axis extending perpendicular to the x-axis and generally parallel to the ground when the head is in the address position where a positive y-axis extends from the face and through the rearward portion of the body, and a z-axis extending perpendicular to the ground, to the x-axis and to the y-axis when the head is ideally positioned where a positive z-axis extends from the origin and generally upward, wherein the golf club head has a center of gravity with an x-axis coordinate between about −2 mm and about 7 mm, a y-axis coordinate between about 30 mm and about 40 mm, and a z-axis coordinate between about −7 mm and about 2 mm.

14. The golf club head of claim 1, wherein the golf club head has a head origin defined as a position on the face plane at a geometric center of the face, the head origin including an x-axis tangential to the face and generally parallel to the ground when the head is in an address position where a positive x-axis extends towards the heel portion, a y-axis extending perpendicular to the x-axis and generally parallel to the ground when the head is in the address position where a positive y-axis extends from the face and through the rearward portion of the body, and a z-axis extending perpendicular to the ground, to the x-axis and to the y-axis when the head is ideally positioned where a positive z-axis extends from the origin and generally upward, wherein the golf club head has a center of gravity with a z-axis coordinate being less than about −2 mm.

15. The golf club head of claim 1, wherein the golf club head has a head origin defined as a position on the face plane at a geometric center of the face, the head origin including an x-axis tangential to the face and generally parallel to the ground when the head is in an address position where a positive x-axis extends towards the heel portion, a y-axis extending perpendicular to the x-axis and generally parallel to the ground when the head is in the address position where a positive y-axis extends from the face and through the rearward portion of the body, and a z-axis extending perpendicular to the ground, to the x-axis and to the y-axis when the head is ideally positioned where a positive z-axis extends from the origin and generally upward, wherein the golf club head has a center of gravity with a y-axis coordinate being greater than about 15 mm.

16. The golf club head of claim 1, wherein the golf club head has a head origin defined as a position on the face plane at a geometric center of the face, the head origin including an x-axis tangential to the face and generally parallel to the ground when the head is in an address position where a positive x-axis extends towards the heel portion, a y-axis extending perpendicular to the x-axis and generally parallel to the ground when the head is in the address position where a positive y-axis extends from the face and through the rearward portion of the body, and a z-axis extending perpendicular to the ground, to the x-axis and to the y-axis when the head is ideally positioned where a positive z-axis extends from the origin and generally upward, wherein the golf club head has a center of gravity with a z-axis coordinate being less than about −2 mm and a y-axis coordinate being greater than about 15 mm, the golf club head further comprising a moment of inertia about a head center of gravity z-axis of at least about 500 $kg \cdot mm^2$ and a moment of inertia about a head center of gravity x-axis of at least about 300 $kg \cdot mm^2$.

17. There golf club head of claim 1, wherein the golf club head has a first sole mode frequency greater than about 3000 Hz.

18. The golf club head of claim 1, wherein the removal of the at least one indentation from the bottom portion creates a second body volume that is between about 12 $cm^3$ and 20 $cm^3$ larger than the first body volume.

19. The golf club head of claim 1, wherein the silhouette profile defines a top portion surface area $S_t$ above the silhouette profile and a bottom portion surface area $S_b$ below the silhouette profile, where $$\frac{S_t}{S_b} \leq 0.96.$$

20. The golf club head of claim 1, wherein the silhouette profile defines an outermost boundary of the body in the X-direction and Y-direction, the area defined by the silhouette profile defines a top portion volume and a bottom portion volume, and the bottom portion volume is greater than about 50% of the first body volume.

21. A golf club head comprising:

a body including a first exterior surface defining a first volume of about 400 $cm^3$ to 470 $cm^3$, the body having a bottom portion, a top portion, a front portion, and a back portion;

a face positioned at the front portion of the body, the face being configured to receive an impact;

a silhouette profile located along a perimeter of the body, the silhouette profile defining the outermost bounds of the body in an X-direction and a Y-direction, the X-direction and the Y-direction defining a plane that is parallel to the ground when the golf club is in an address position, and the silhouette profile defining a boundary between the top portion and the bottom portion, the top portion having a top portion surface area $S_t$ and the bottom portion having a bottom portion surface area $S_b$ where $$\frac{S_t}{S_b} \leq 0.96; \text{ and}$$

at least one indentation located on the bottom portion, wherein the removal of the at least one indentation from the bottom portion creates a second exterior surface of the body having a second volume, wherein the second volume is about 4% to about 5% larger than the first volume.

22. A golf club head comprising:

a body including a first exterior surface defining a total volume of about 400 $cm^3$ to 470 $cm^3$, the body having a bottom portion, a top portion, a front portion, and a back portion;

a face positioned at the front portion of the body, the face being configured to receive an impact;

a top portion silhouette profile located along an outer boundary of the top portion, the top portion silhouette portion defining an outermost boundary of the body in an X-direction and Y-direction and defining an area of at least about 11,000 $mm^2$ when projected onto an X-Y plane, the top portion silhouette profile defining a top portion volume and a bottom portion volume that together define the total volume; and at least one indentation located on the bottom portion, wherein the at least one indentation is configured such that the bottom portion volume is greater than about 50% of the total volume.

23. A golf club head of claim 22, wherein the bottom portion volume is greater than about 60% of the total volume.

24. A golf club head comprising:

a body including an exterior surface defining a first body volume of at most about 470 $cm^3$, the body having a bottom portion, a top portion, a front portion, and a back portion;

a face positioned at the front portion of the body, the face being configured to receive an impact;

a top portion silhouette profile located along a perimeter of the top portion, the top portion silhouette profile defining the outer bounds of the top portion in an X-direction and a Y-direction and defining an area of at least about 11,000 $mm^2$ when projected onto an X-Y plane; and at least one indentation located on the bottom portion below the top portion silhouette profile, wherein the removal of the at least one indentation from the bottom portion creates a second body volume that is at least 12 $cm^3$ larger than the first body volume;

wherein the body comprises at least eight similarly sized round indentations located on the bottom portion below the silhouette profile, wherein the removal of the indentations from the bottom portion creates a second body volume that is at least 15 $cm^3$ larger than the first body volume.

* * * * *